US006298989B1

(12) United States Patent
Chu

(10) Patent No.: US 6,298,989 B1
(45) **Date of Patent: *Oct. 9, 2001**

(54) PACKAGE CASE

(76) Inventor: Cheng-Kang Chu, No. 228, Niu Pu South Road, Hsin Chu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/493,048

(22) Filed: Jan. 28, 2000

(30) Foreign Application Priority Data

Nov. 4, 1999 (TW) ..... 88218779 U
Nov. 4, 1999 (TW) ..... 88218780 U

(51) Int. Cl.[7] ..... B65D 85/00
(52) U.S. Cl. ..... 206/320; 206/592; 206/564
(58) Field of Search ..... 206/562, 564, 206/591, 592, 593, 586, 509, 320, 511, 512, 701, 710, 521, 557, 576, 588

(56) References Cited

U.S. PATENT DOCUMENTS 3,311,231 * 3/1967 English, Jr. ..... 206/523
3,471,116 * 10/1969 Cherrie ..... 206/523
3,580,467 * 5/1971 Pieszak ..... 206/523
4,173,286 * 11/1979 Stanko ..... 206/523
4,287,990 * 9/1981 Kurick ..... 206/454
5,366,080 * 11/1994 Carstersen et al. ..... 206/523
5,515,976 * 5/1996 Moren et al. ..... 206/586
5,678,692 * 10/1997 Gratz ..... 206/453
5,706,951 * 1/1998 Oimuma et al. ..... 206/710
5,715,940 * 2/1998 Son ..... 206/320
6,105,765 * 8/2000 Chu ..... 206/320
6,109,444 * 8/2000 Bagwell et al. ..... 206/589
6,123,200 * 9/2000 Stephens et al. ..... 206/592

* cited by examiner

*Primary Examiner*—Shian Luong
(74) *Attorney, Agent, or Firm*—Rosenberg, Klein & Lee

(57) ABSTRACT

A package case includes an upper and a lower case, but only a lower case can be used independently, having air cushion effect. The package case can have a thin upper case, the rear and the bottom portion can be completely or half sealed, and then directly placed in a carton tightly. The package case cannot produce gas explosion or vibration even in case of sudden shock by increasing thickness of material or forming holes when completely or half sealed. Further the package case has various projections, tabs, recesses for space for air flow in case of shock, and the bottom is also formed with various structure to contact or suspend an object to be packed. The contact places are strengthened with reinforcing means in conjunction with various foldable recesses to increase cushion effect for protecting the object packed from damaged.

4 Claims, 31 Drawing Sheets

PACKAGE CASE

BACKGROUND OF THE INVENTION

This invention relates to a package case, particularly to one having four circumferential walls of special structure producing shock-absorbing function, and permitting the package case possess excellent buffering and shock-absorbing effect.

Package cases generally have material and structure for different products, from simple things to sophisticated electronic appliances. As for computers and related appliances, Styrofoam package cases are used for packing them with their thick walls, protecting them from shocks during transporting, and sometimes air bubble bags are used for small products instead of Styrofoam. However, Styrofoam package cases have to be made by means of accurate and complete molds owing to special features of Styrofoam, and may produce toxic gas and odor in manufacturing process, presenting potential danger to people and animals in a factory and its neighborhood. Light Styrofoam package cases generally have large dimensions, impossible to fold or insert in each other, resulting in high charge for transporting and storage, unprofitable for makers.

In addition, Styrofoam has inferior expansibility to produce easily rupture or rip off, lowering its protective effect, and if worse, losing protective function. When consumers buy a product contained in a Styrofoam package case, the Styrofoam package case becomes useless after the product is taken off, uneasy to treat or discard owing to its largeness. When it is discarded, it may produce toxic gas and odor in case of burning, making up a second public harm to the environment. As for air bubble bags, though they have good shock-absorbing effect, air bubbles may be punctured during transporting by exterior force, losing shock-absorbing function of the flattened portion, forming risk to the product therein in the remaining course of transporting. Provided air bubble bags should receive one time of large shock to damage a large portion of air bubbles, they may give rise to a large vibration to the product packaged therein to be damaged more or less.

So, a Patent application with filing number Ser. No. 09/342,199 was filed on Jun. 29, 1999 for a package case, in order to improve disadvantages of conventional package cases, as shown in FIG. 53.

SUMMARY OF THE INVENTION

This invention has been devised to offer a package air cushion case, having four circumferential walls provided with stepped projecting continuous edges to let the package case having a complete and effective protective structure, ensuring to keep its outer shape and size stable, hardly changeable, enhancing strength and shock-absorbing, buffering effect.

Another feature of the invention is that tenons and mortises or Velcro bands fixed on an upper end of four corners of an lower case to hook or engage with those on corresponding locations of an upper case, permitting the upper and the lower case tightly and completely surrounding a product put therein, together with a cartoon containing the package case to form double coverage of the product.

Another feature of the invention is the case made of plastic film by means of injecting molding process to have air cushion function, having lateral and lengthwise ribs in a recess portion in the interior as a structural supplement to absorb forward and rearward and right and left vibrations, and also vertical vibrations, to perfect protective effect.

One more feature of the invention is sloping surfaces continually provided on the four circumferential walls to endure and disperse inclining force to the product, increasing protective effect.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
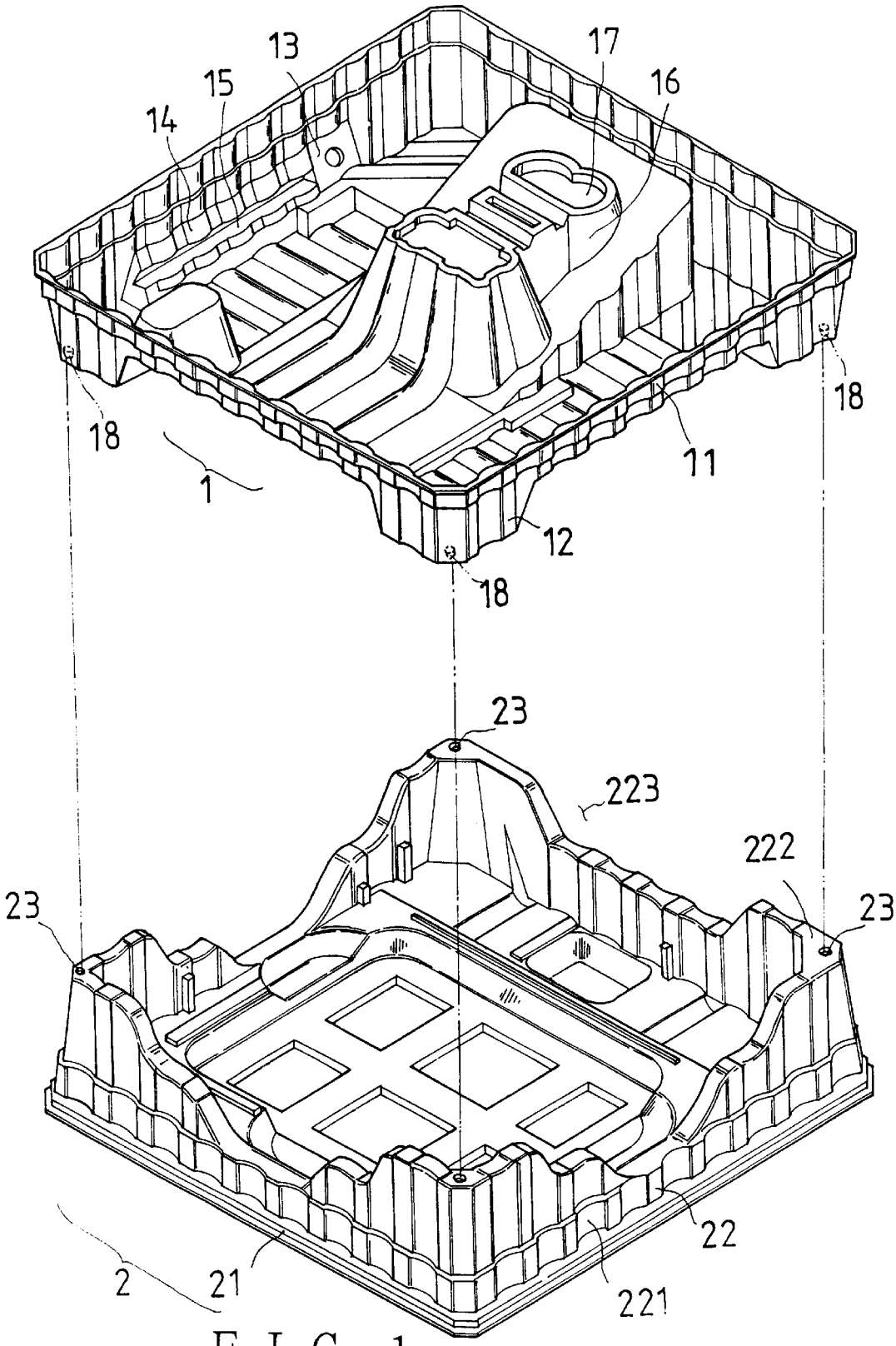
FIG. 1 is an exploded perspective view of a package case of the present invention.
Figure 2:
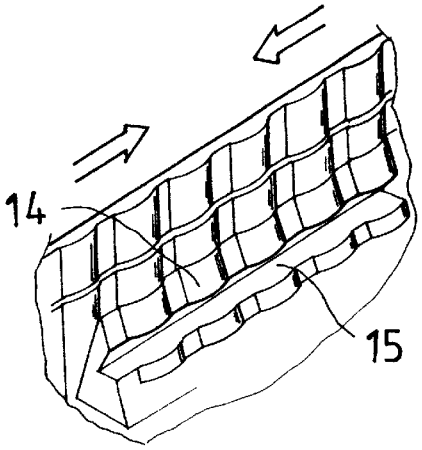
FIG. 2 is an enlarged cross-sectional view of a large inclined surface and a folding recess in the package case of the present invention.
Figure 3:
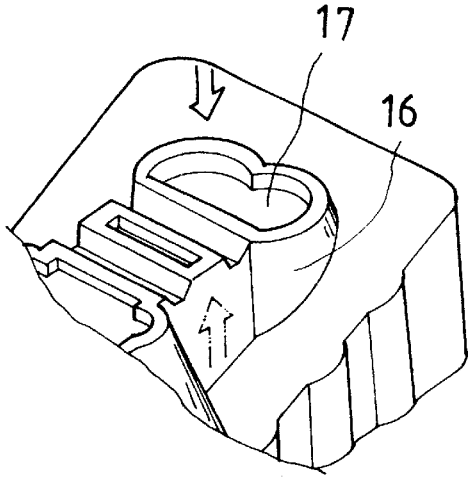
FIG. 3 is an enlarged cross-sectional view of a shaped projection in the package case of the present invention.

A preferred embodiment of a package case in the present invention, as shown in FIG. 1, includes an upper case 1 and a lower case 2. The upper case 1 is made of a tough material (such as plastic, cardboard, EPE, etc.) formed into hollow case shape by means of molding process, having four peripheral walls 11, four projecting-down corner walls 12 formed at four corners, a large sloped surface 13 formed inside between two projecting corner walls 12. The projecting corner walls 12 and the large sloped surface 13 all have plural concave and convex surfaces 14 to reinforce the upper case 1, and a horizontal folding recess 15 extends in the sloped surface 13 as another directional reinforcement. (Force receiving and dispersing is shown in FIG. 2) And a shaped projection 16 is formed inside on a sloped surface on the bottom, defining a shallow recess 17 to function as a vertical buffer (its structure, force receiving dispersing are shown in FIG. 3). Further a tenon 18 is provided in a lower end of the four corner walls 12. But the tenon 18 can be replaced with a Velcro band, as shown in FIGS. 2 and 3.

Figure 5:
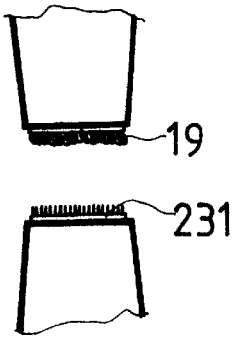
FIG. 5 is a cross-sectional view of two Velcro bands in the package case of the present invention.
Figure 4:
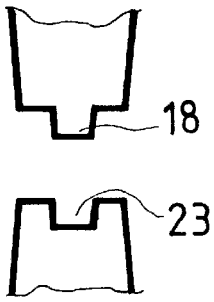
FIG. 4 is a side view of a tenon and a mortise in the package case of the present invention.
Figure 8:
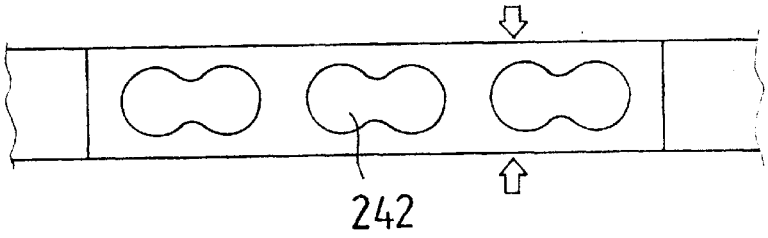
FIG. 8 is a side view of a third recess in the package case of the present invention.
Figure 7:
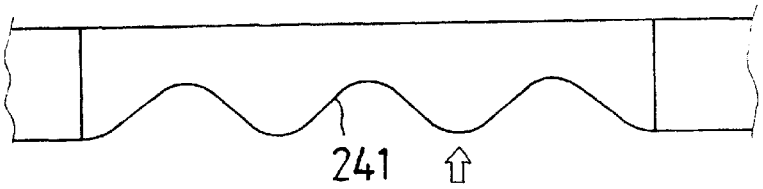
FIG. 7 is a side view of a second wave recess in the package case of the present invention.
Figure 6:
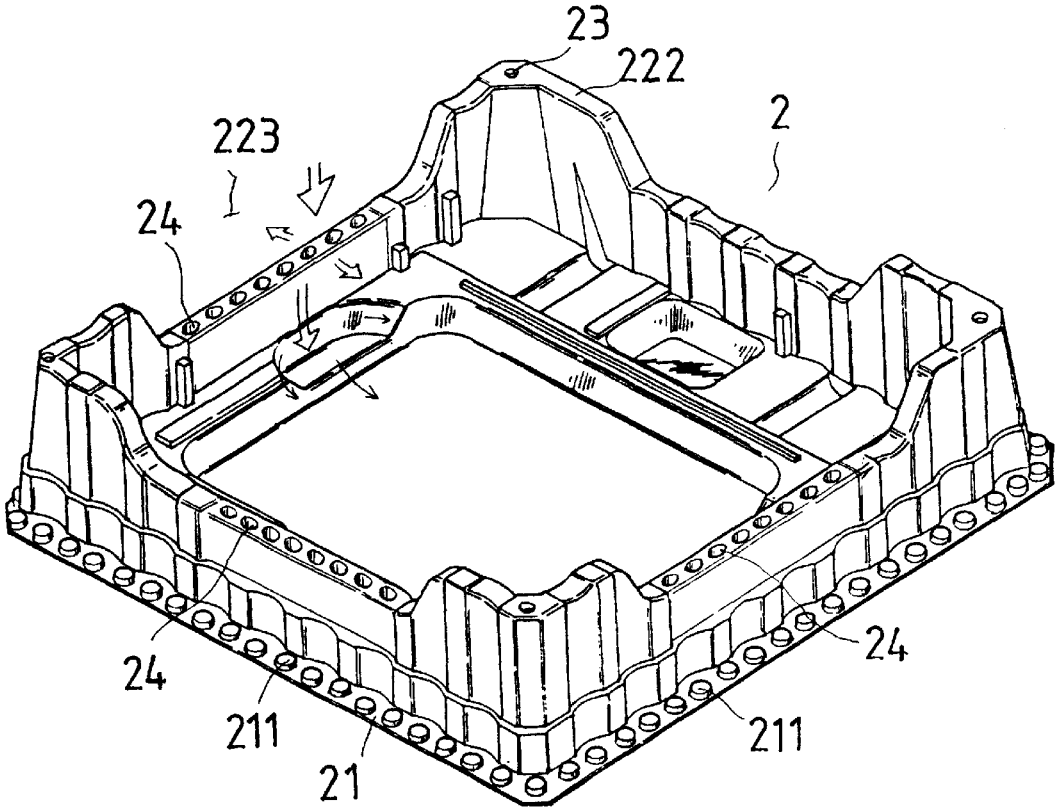
FIG. 6 is a perspective view of a first recess in the package case of the present invention.

The lower case 2 is made of a tough material (such as plastic, cardboard, EPE, etc.) formed into a preset hollow case, having stepped projecting edges 21 (one or more steps) around an outer lower end of the four peripheral side walls 22 provided with concave and convex surfaces 221 alternately, four projecting up corner walls 222, a shorter wall 223 formed between every two corner walls 222. Each corner wall 222 has a mortise 23, and each shorter wall 223 has plural holes 24 spaced apart, as shown in FIG. 6. The mortise 23 can be replaced with a Velcro band as shown in FIG.5. The recesses 223 can be shaped to have an outer wave recess 241 (its structure, receiving force and force dispersing is shown in FIGS. 7 and 8) or two holes 242 connected with each other. Further, the stepped projecting-out edges 21 may provide with plural tabs 211 to let it have air cushion function to increase shock-absorbing and strengthening the structure, as shown in FIG. 6.

Figure 10:
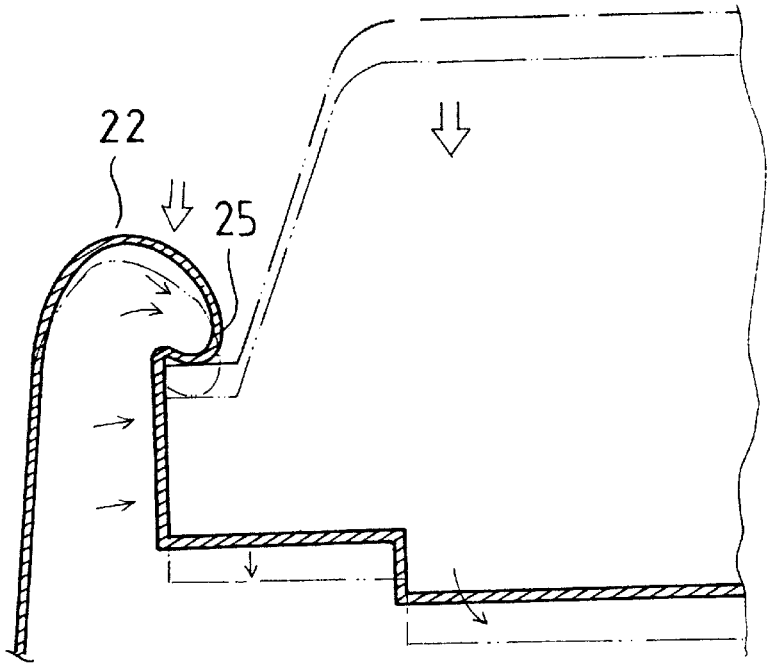
FIG. 10 is a side view of tabs and flat plates in the package case of the present invention, showing them receiving exterior force.
Figure 9:
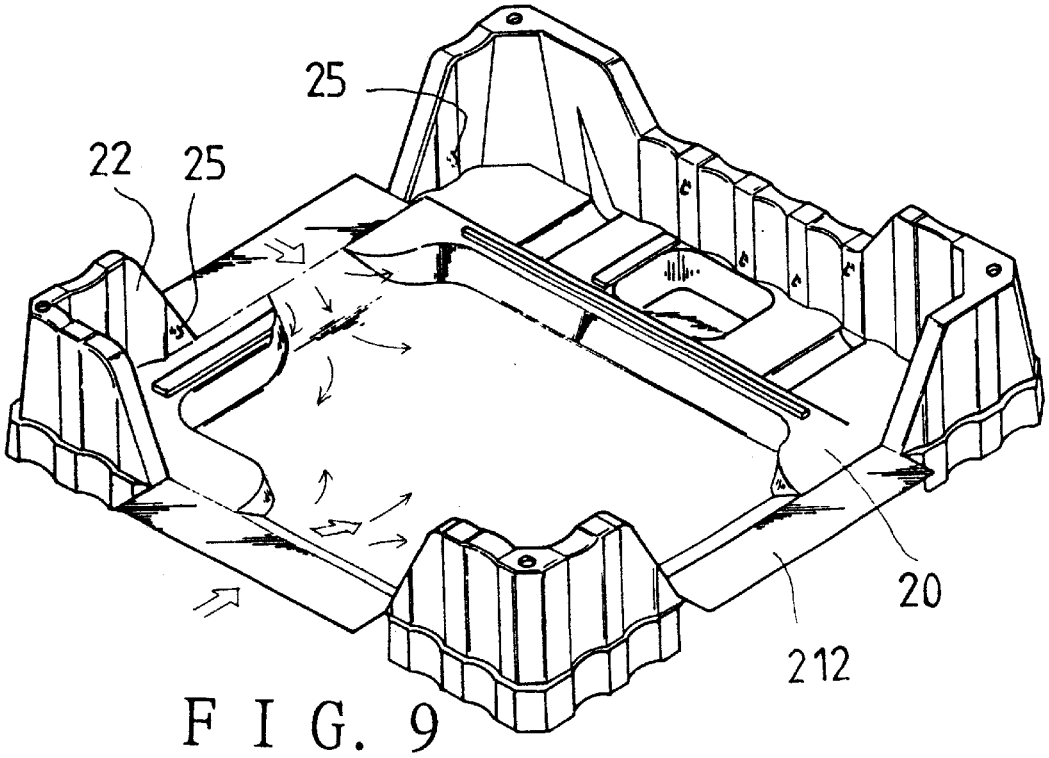
FIG. 9 is a perspective view of tabs on an inner surface of the side wall and two flat plates outside of the side wall in the package case of the present invention.

Further, convex projections 25 are provided inside the side walls 22 for contacting an object to be packed to secure it in a lower package case 2, as shown in FIGS. 9 and 10. The four side walls each have a flat plate 212 projecting thereout and flush with or a little lower than the flat receiving surface 20 so that the flat plates 212 can endure exterior force and deform properly to buffer the force. Thus, the side walls and their upper sides may not directly receive exterior force, nor the objected packed inside may directly receive exterior force. (Receiving and dispersing force is shown in FIGS. 9 and 10.)

Figure 11:
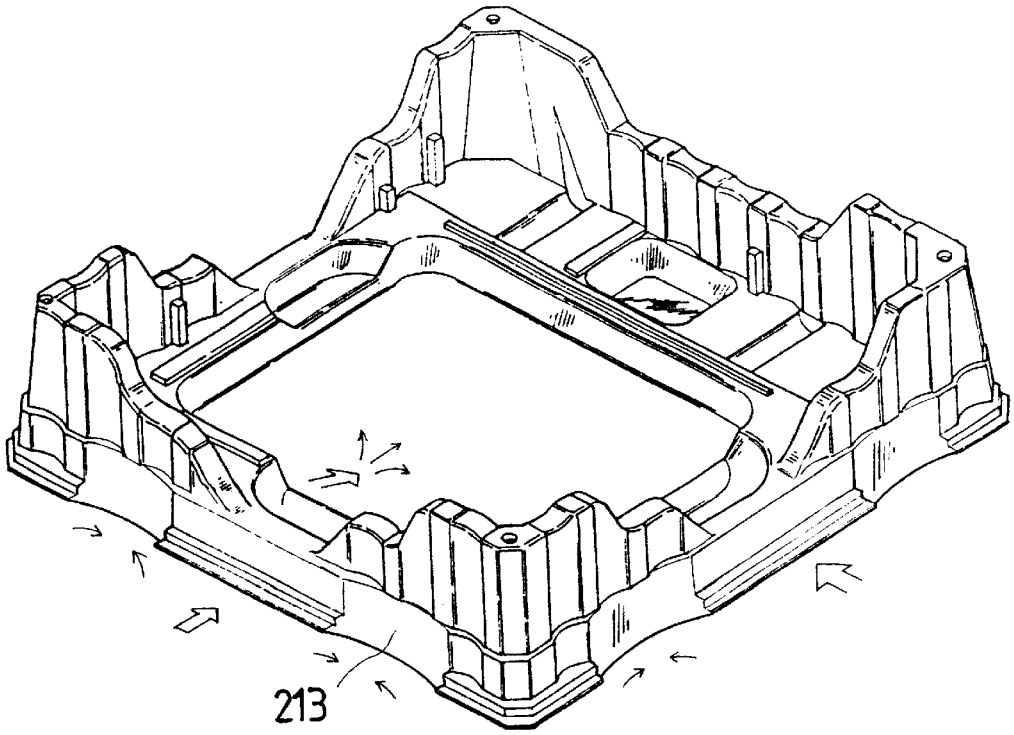
FIG. 11 is a perspective view of curved recesses formed in lower outer surface of the side wall of the lower package case of the present invention.

Next, referring to FIG. 11, a large concave surface 213 may be formed on an outer intermediate portion of the side walls 22, letting the four corners of the lower case 2 to contact with a carton, and the concave surfaces 213 avoid shocking force from directly transmitted to the four sides of the lower case 2, augmenting buffer function to reduce harm. (Receiving and dispersing force is shown in FIG. 11.)

Figure 12:
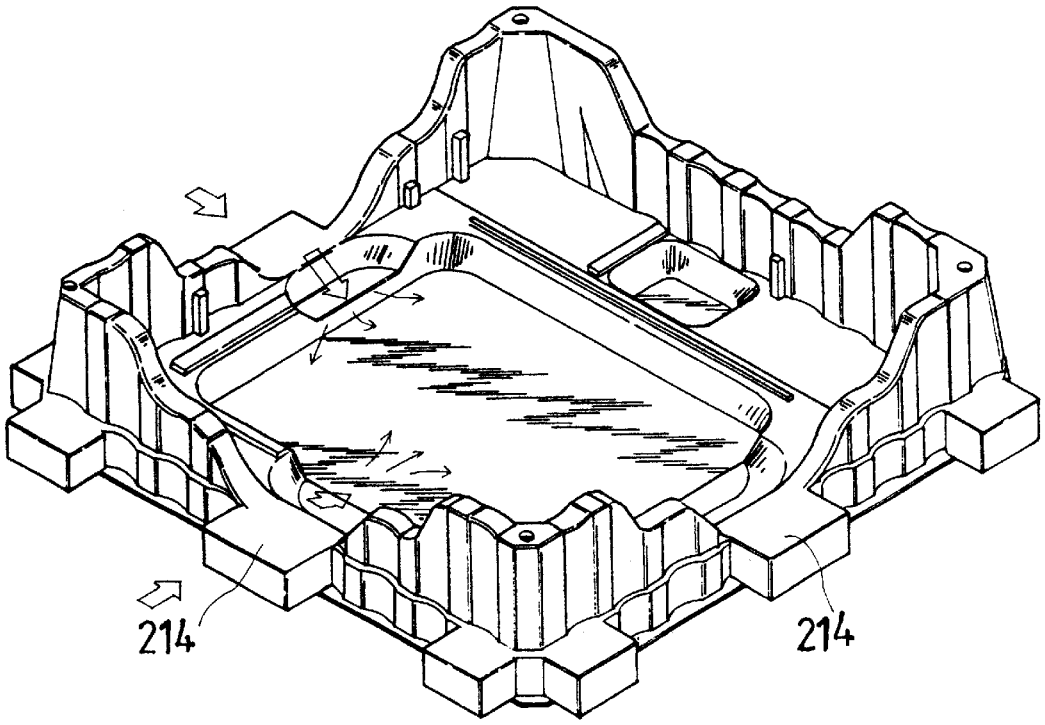
FIG. 12 is a perspective view of projecting blocks outside the side walls of a lower package case of the present invention.
Figure 13:
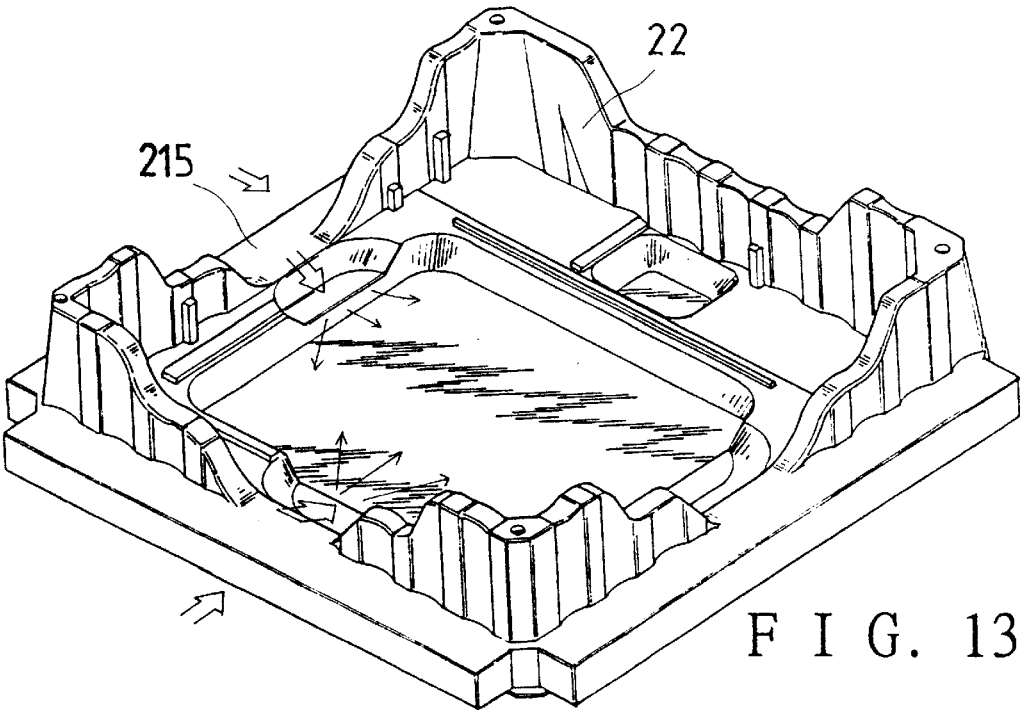
FIG. 13 is a perspective view of long plate blocks formed to protrude out the side walls of a lower package case of the present invention.

Next, as shown in FIG. 12, the lower case 2 may be provided with a plurality of projecting square blocks 214 extending out from the side walls 22 or an elongate plate 215 on every side wall 22 (shown in FIG. 13) for absorbing shocks by their elasticity to disfigure first, then by the side walls 22 for a second time, so as to keep the product therein safe. (Receiving and dispersing force is shown in FIGS. 12 and 13.

Figure 14:
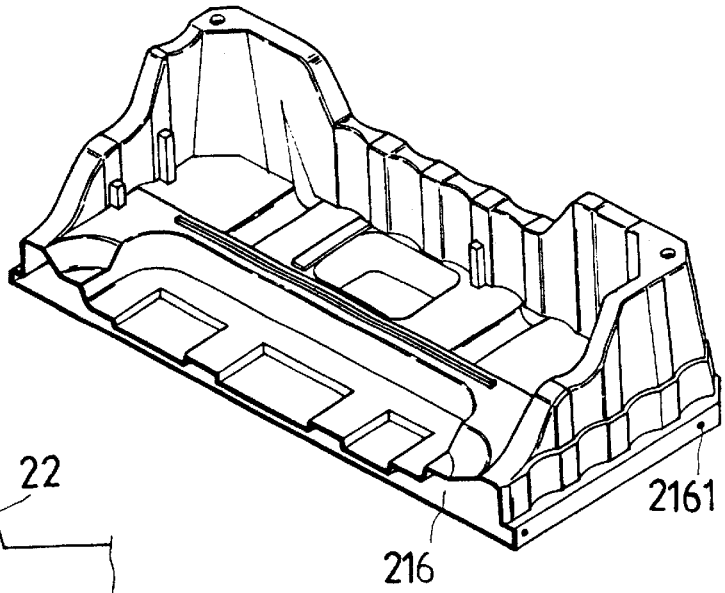
FIG. 14 is a perspective view of the structure of a closed bottom of a lower package case of the present invention.
Figure 15:
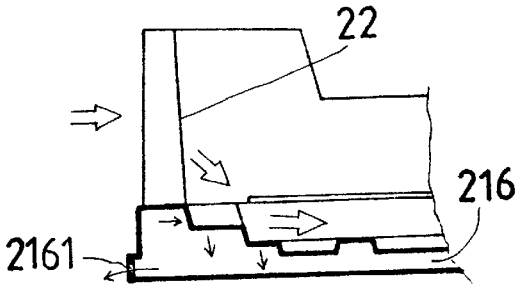
FIG. 15 is a partial cross-sectional view of the closed bottom of a lower package case of the present invention.

Next, as shown in FIGS. 14 and 15, the lower case 2 may have a sealed bottom wall 216 with plural air holes 2161 to increase air cushion effect. (Force receiving and dispersing is shown in FIG. 15.)

Figure 17:
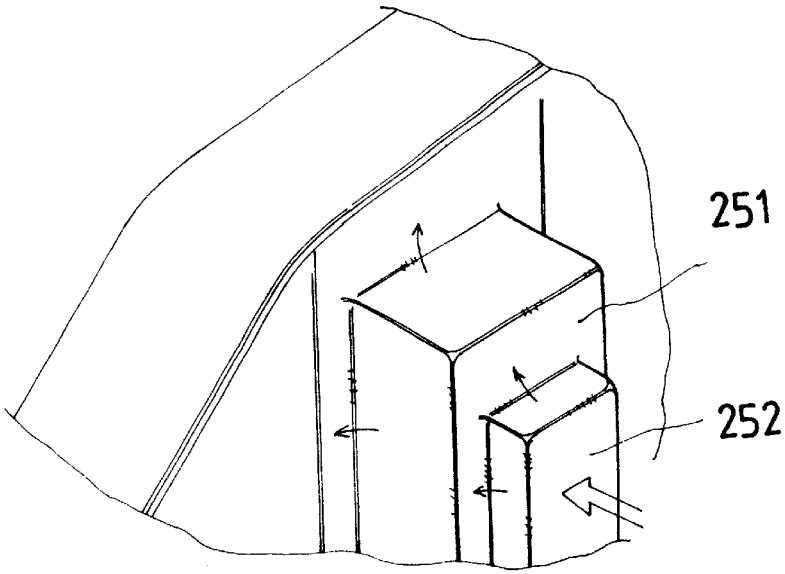
FIG. 17 is a perspective view of a vertical post formed on an inner surface of the side wall of a lower package case of the present invention.
Figure 16:
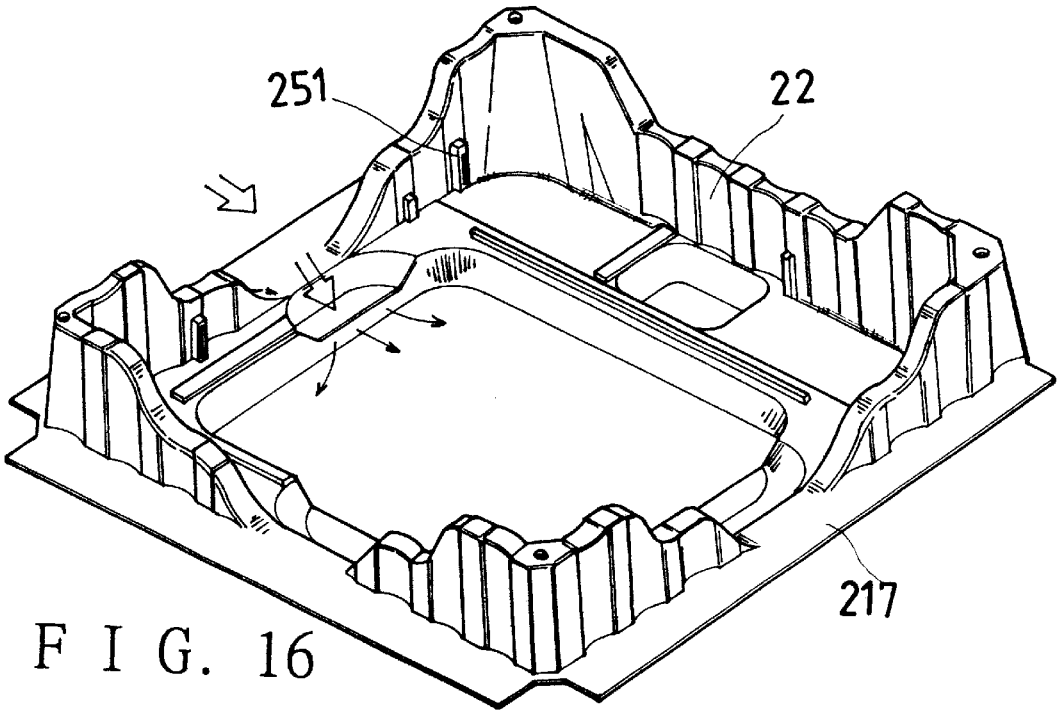
FIG. 16 is a perspective view of a flat long plates formed outside the side walls in a lower package case of the present invention.

Next, as shown in FIGS. 16 and 17, the four side walls 22 of the lower case 2 may have a projecting-out flat elongate members 217 to receive external force to disfigure to stave off direct shock to the product therein. The upper case 1 has the side walls 22 provided with posts 251 for increasing enduring strength against exterior force, and upright posts 252 may be added to the posts 251 to augment the enduring force. (Force receiving and dispersing is shown in FIGS. 16 and 17.

Figure 18:
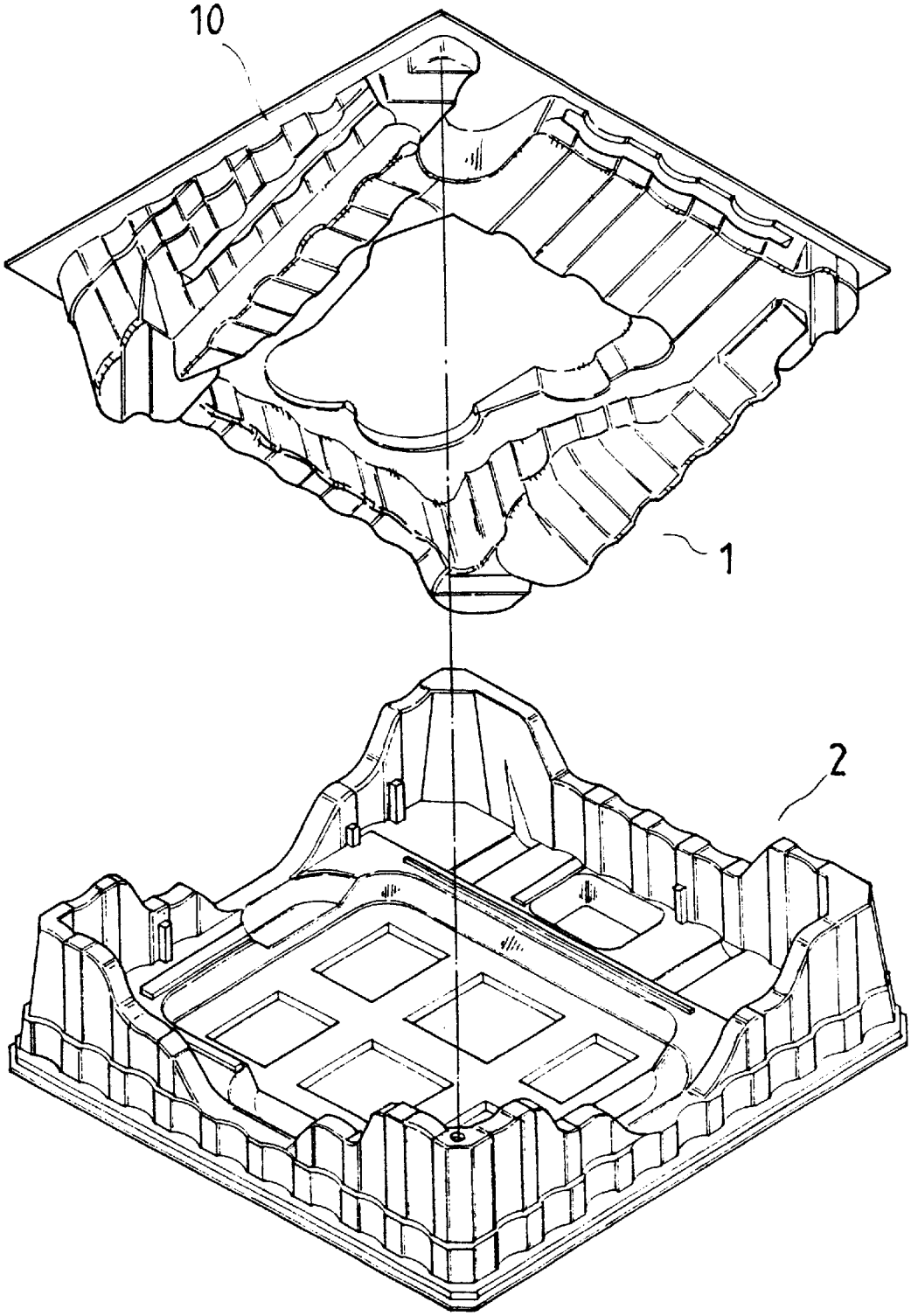
FIG. 18 is a perspective view of inclined side edges of the side walls of an upper package case of the present invention.
Figure 19:
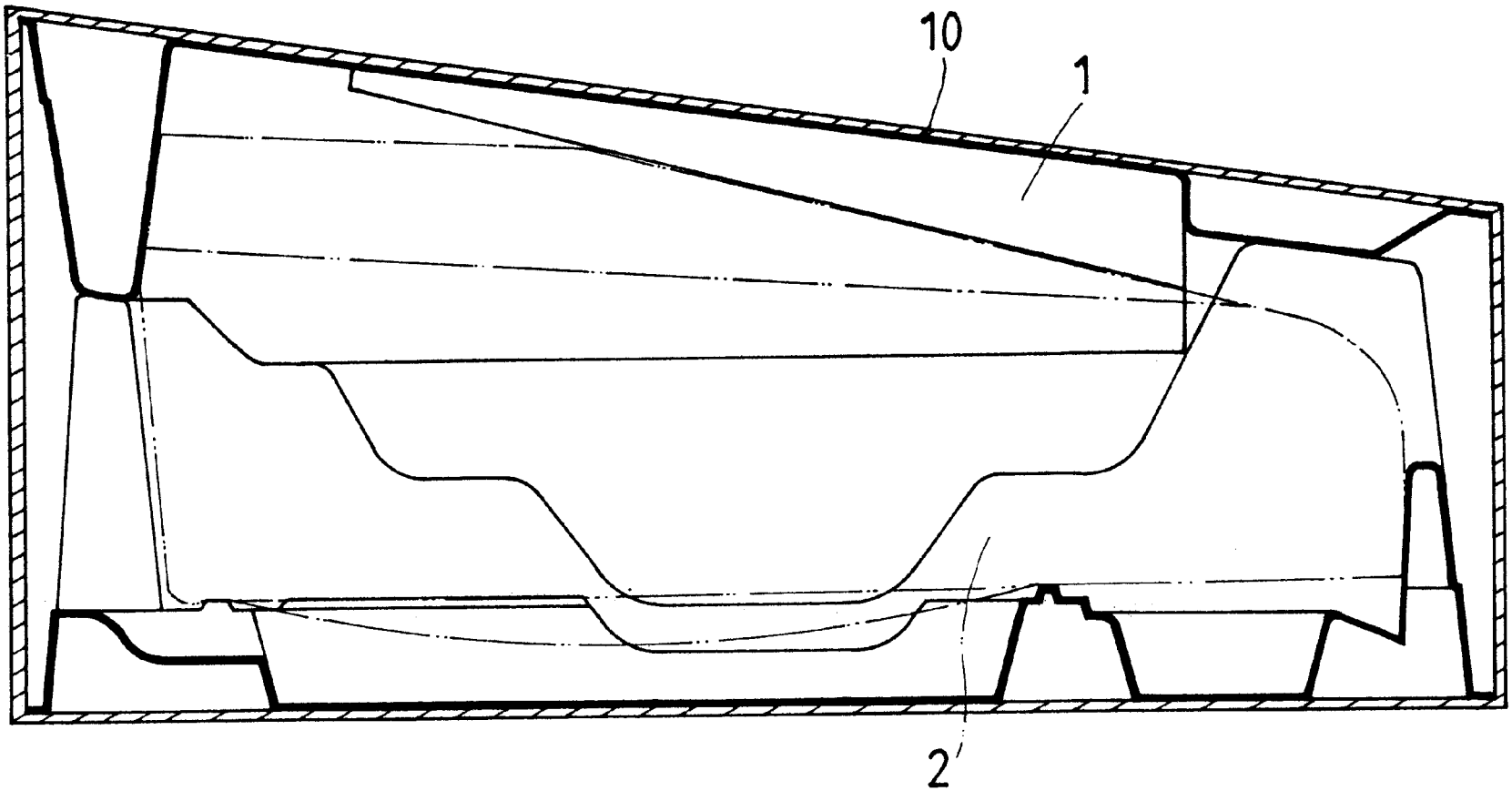
FIG. 19 is a cross-sectional view of the inclined side edges of the side walls of an upper package case combined with a lower package case of the present invention.
Figure 20:
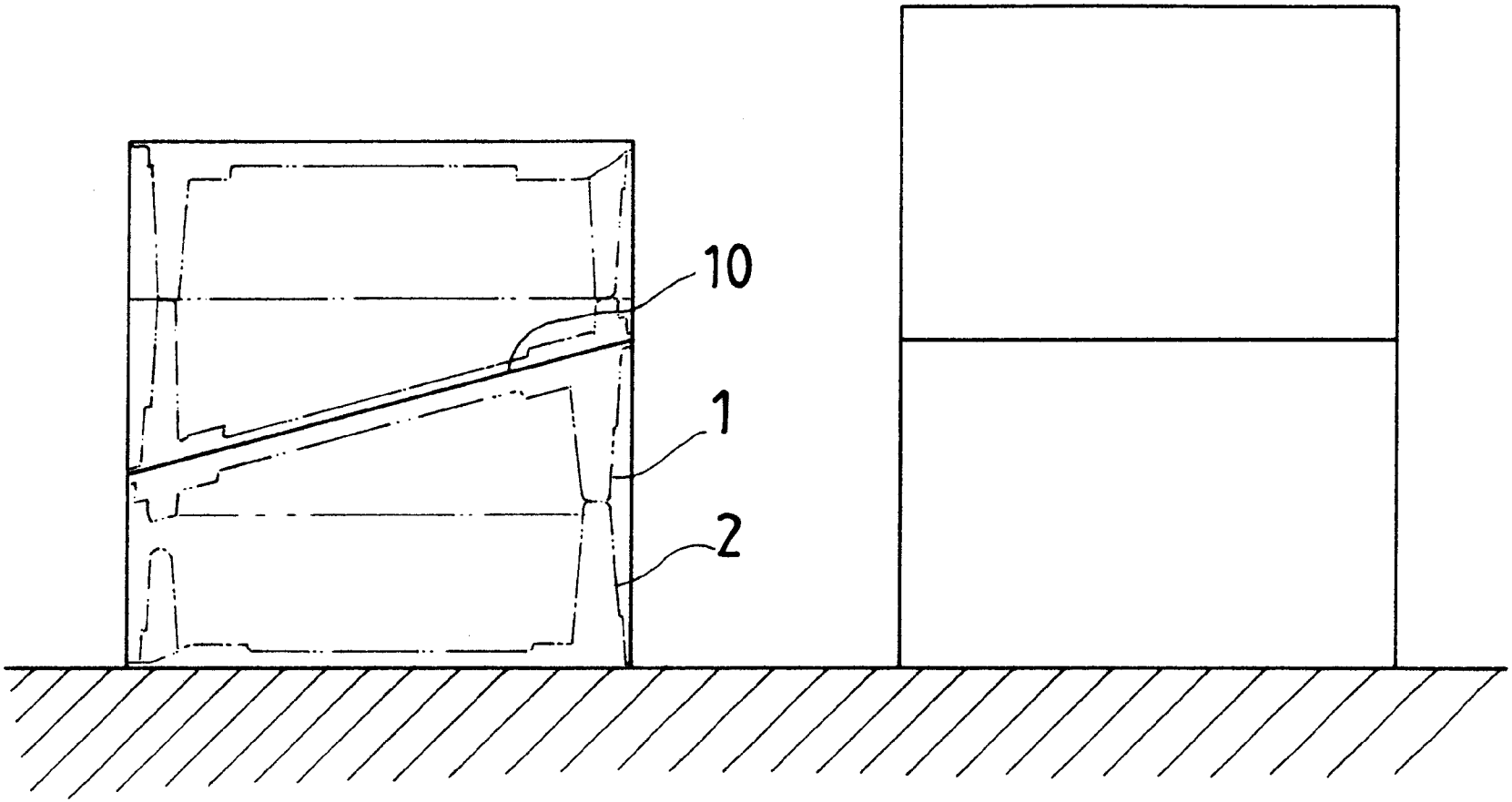
FIG. 20 is a cross-sectional view of the inclined side edges of an upper package case and a conventional package case of the present invention.

As shown in FIG. 18, the upper package case 1 may be provided with an inclined flat long edge 10 on an outer peripheral side to form a large inclined surface when the upper package case is put in a carton as shown in FIG. 19. Thus the inclined flat long edge 10 can save material much (as shown in a left case in FIG. 20, especially in case of two cases piled up, needing less cost than a conventional case shown in a right side case in FIG. 20). In addition, it can save much expense for makers of export products, and lets a package case look pretty and fresh, obtaining various gains.

Figure 21:
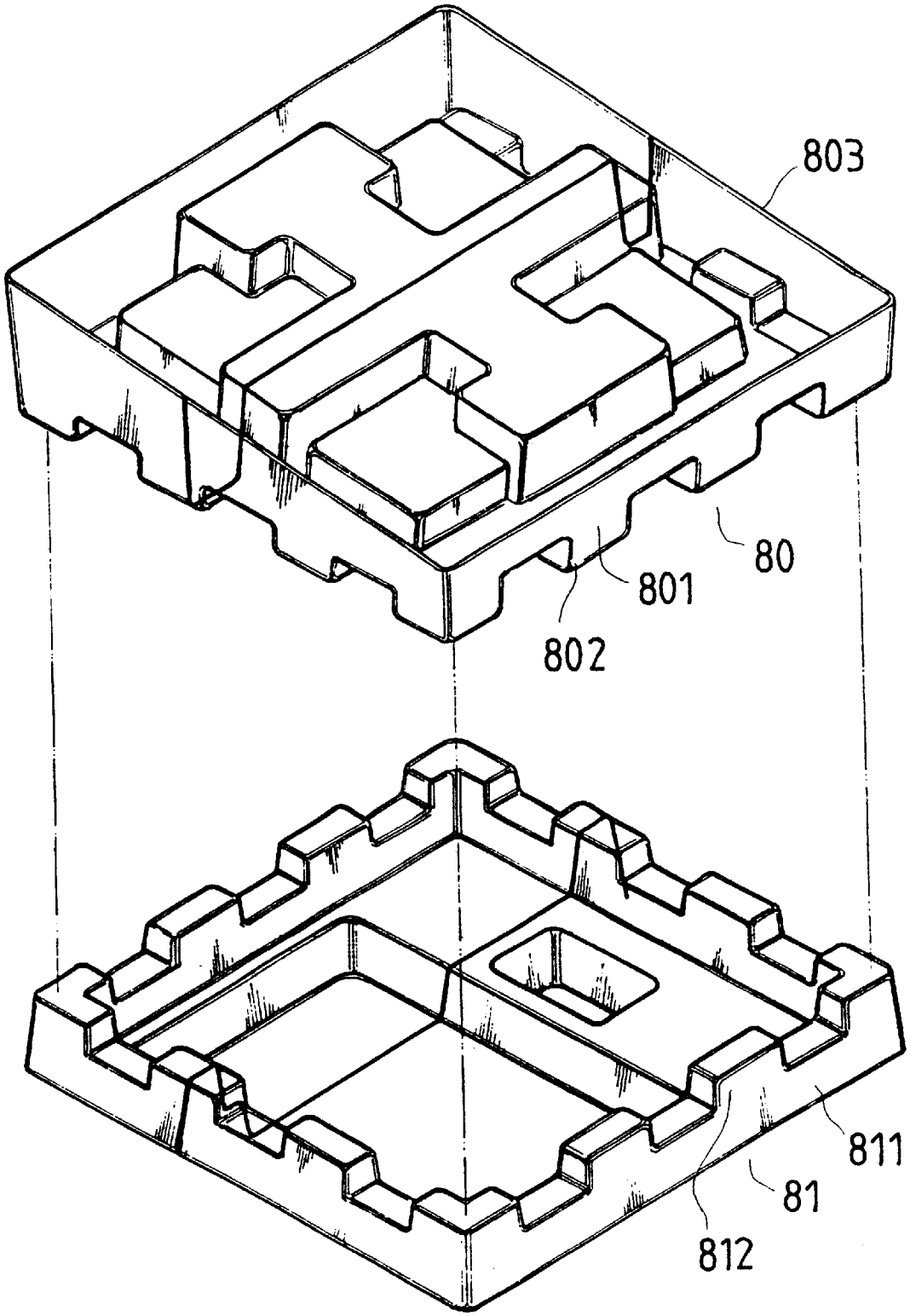
FIG. 21 is a first perspective view of stepless projecting edges of the upper package case and the lower package case of the present invention.
Figure 22:
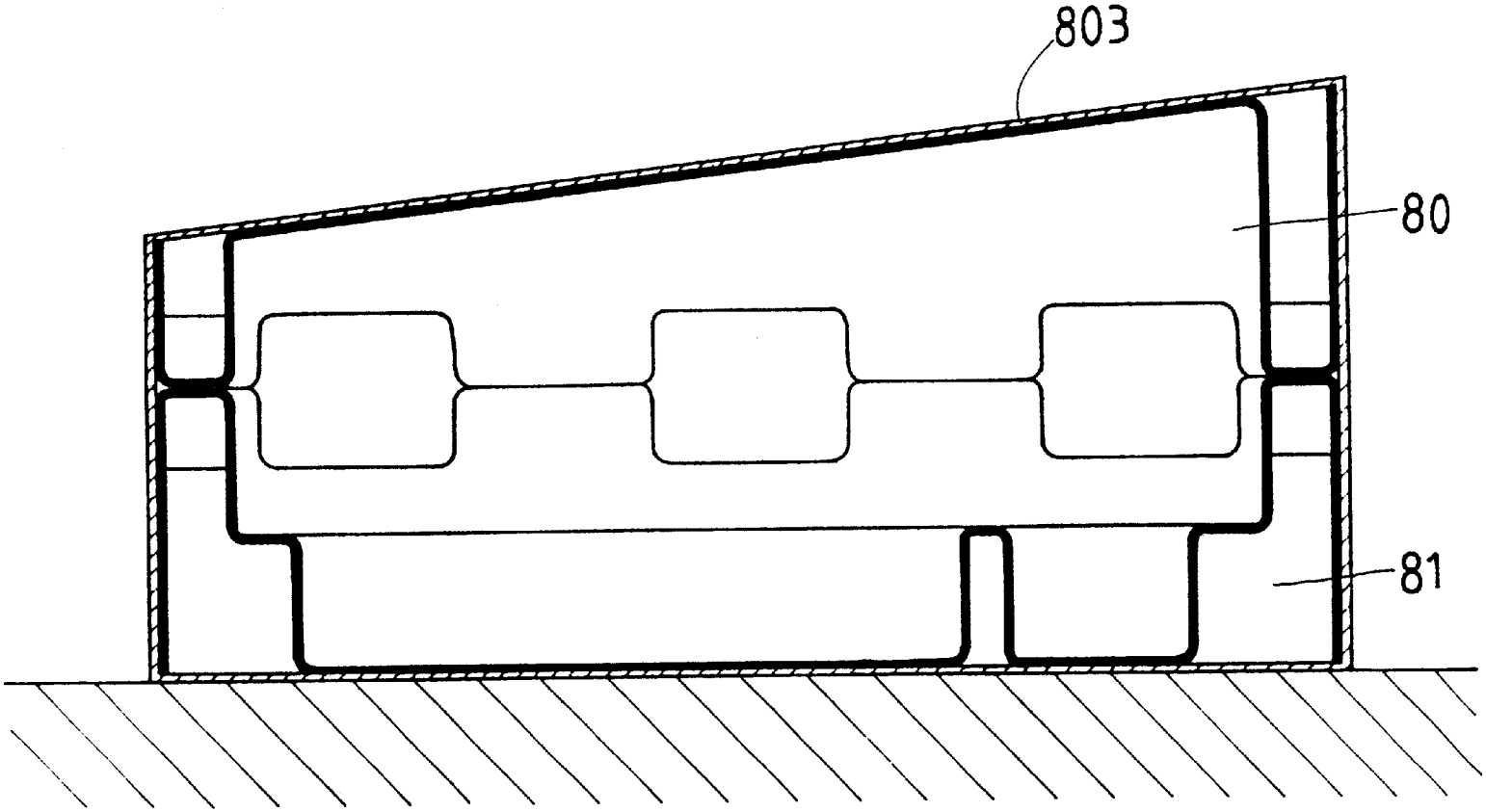
FIG. 22 is a first cross-sectional view of stepless projecting edges of the upper package case combined with the lower package case of the present invention.

Next, as shown in FIGS. 21 and 22, an upper and a lower case 80 and 81 both have stepless projecting edge side walls, but have flat side walls 801, 811, and flat side walls may have sloped surfaces or projections or recesses 802, 812 to function as reinforcement. In addition, the upper case 80 have two opposite sloped upper lengthwise surfaces 803, lessening the height of the carton when the upper and the lower case are placed in the carton.

Figure 23:
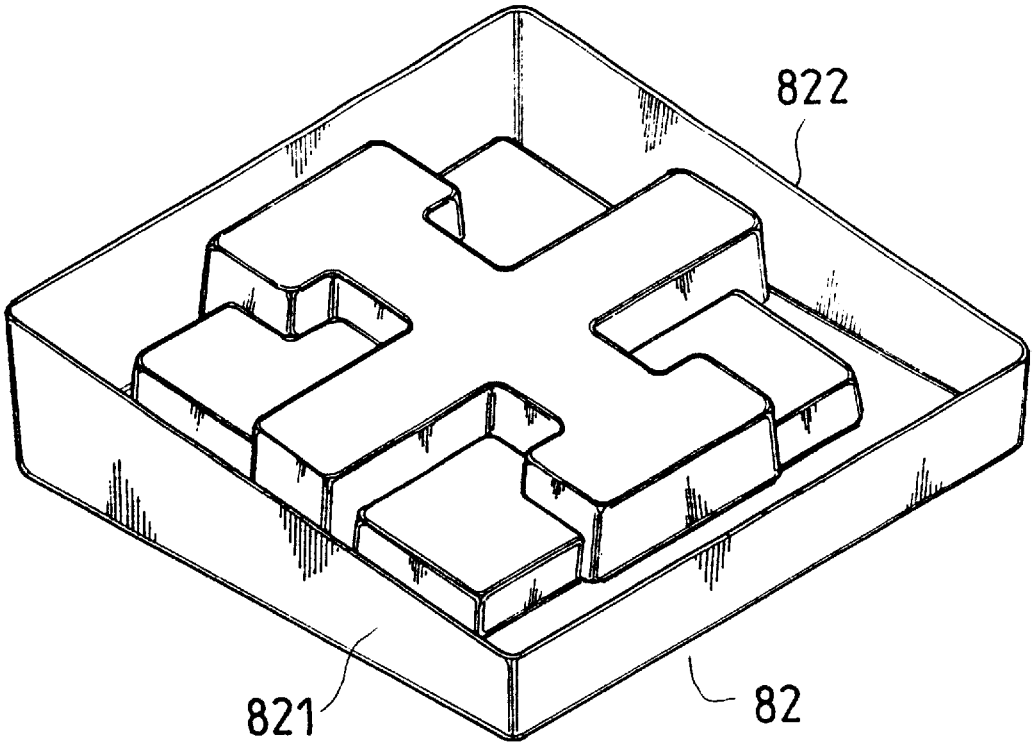
FIG. 23 is a second perspective view of stepless projecting edges of the upper package case and the lower package case of the present invention.
Figure 23:
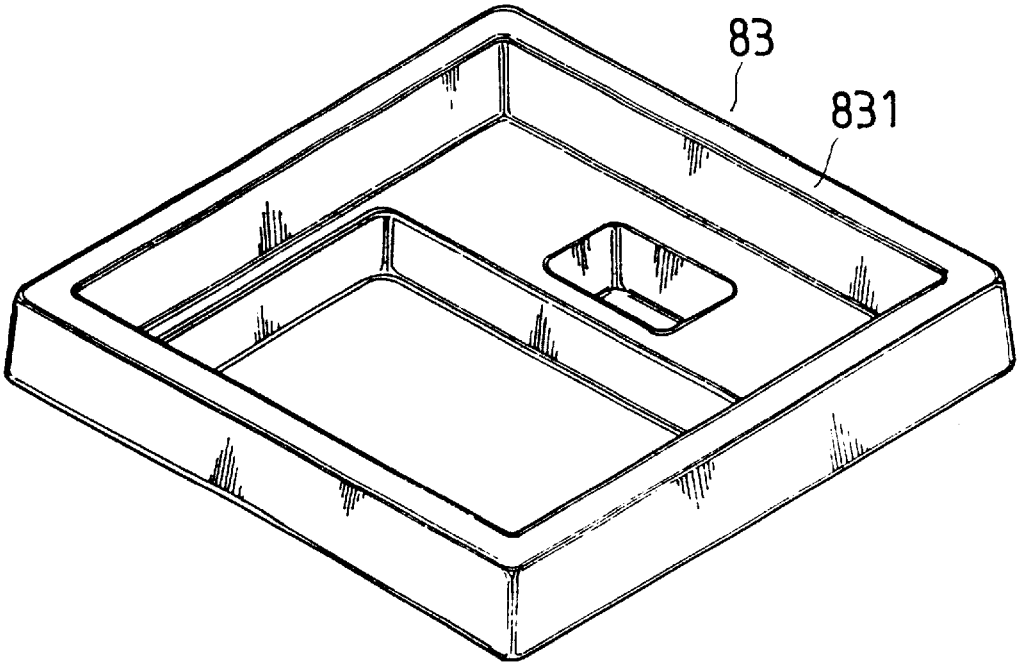
Figure 24:
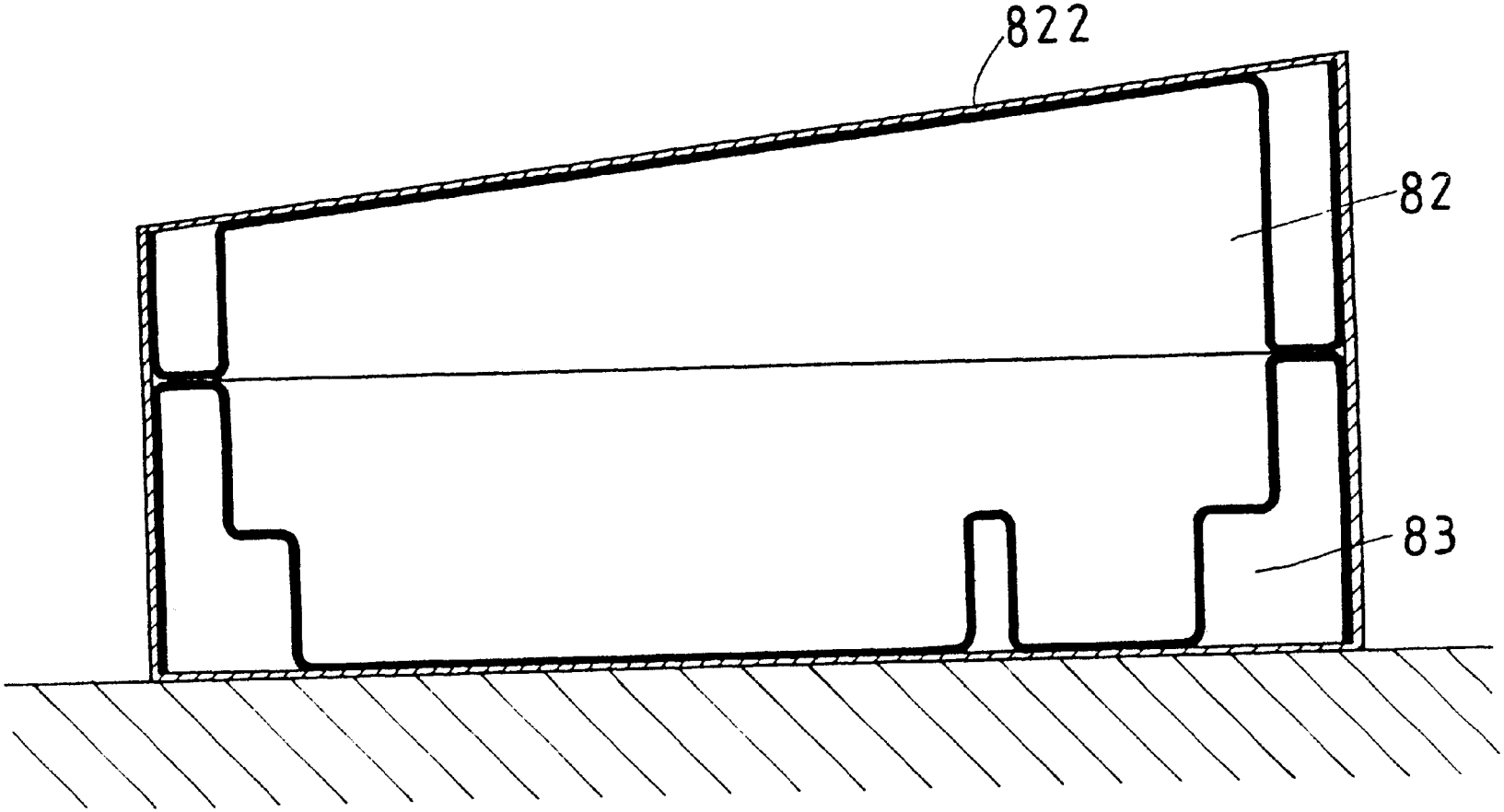
FIG. 24 is a second cross-sectional view of stepless projecting edges of the upper package case combined with the lower package case of the present invention.

FIGS. 23 and 24 show an upper and a lower case 82 and 83 having the different structure from those 80 and 81 just described above. They have no projections and recesses but have flat and straight side walls 821, 831, and the upper case 82 has two opposite sloped upper lengthwise surfaces 822 to lessen the height of the carton.

Figure 25:
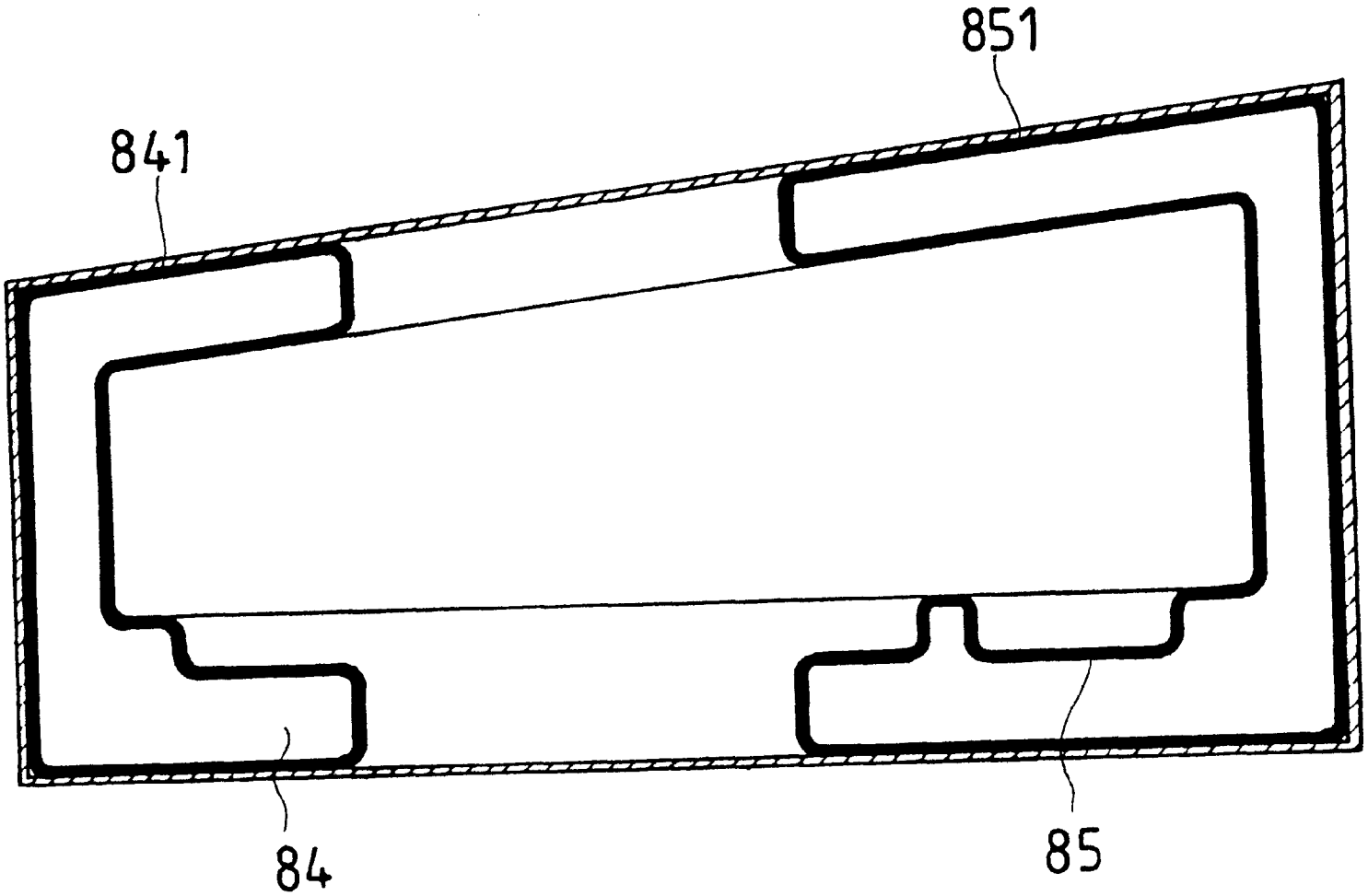
FIG. 25 is a cross-sectional view of left case and right case of the present invention.

Next, FIG. 25 shows a left case 84 and a right case 85 to suit to an object to be packed, having a feature that their upper side wall has a sloped surface 841, 851 so as to form a sloped upper surface of a carton to lessen the height of the carton.

Figure 27:
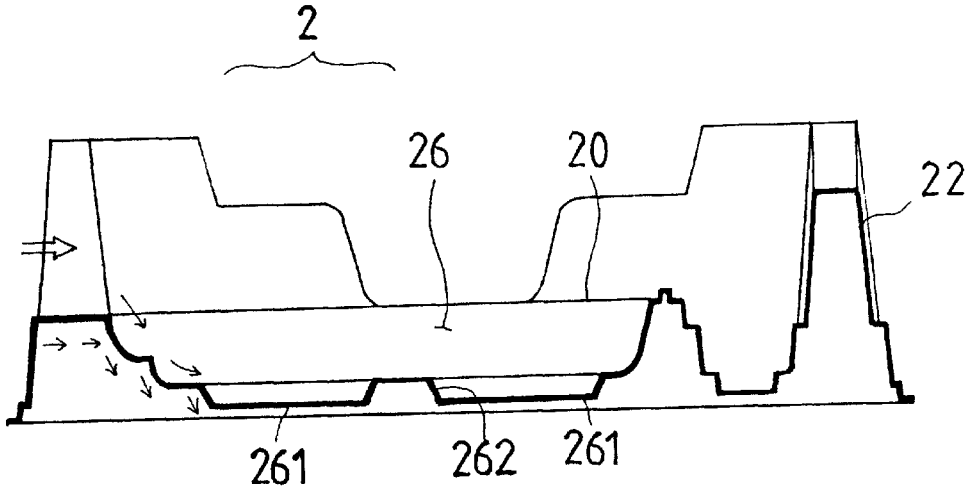
FIG. 27 is a cross-sectional view of the reinforcing projecting-up member in a lower package case of the present invention.
Figure 26:
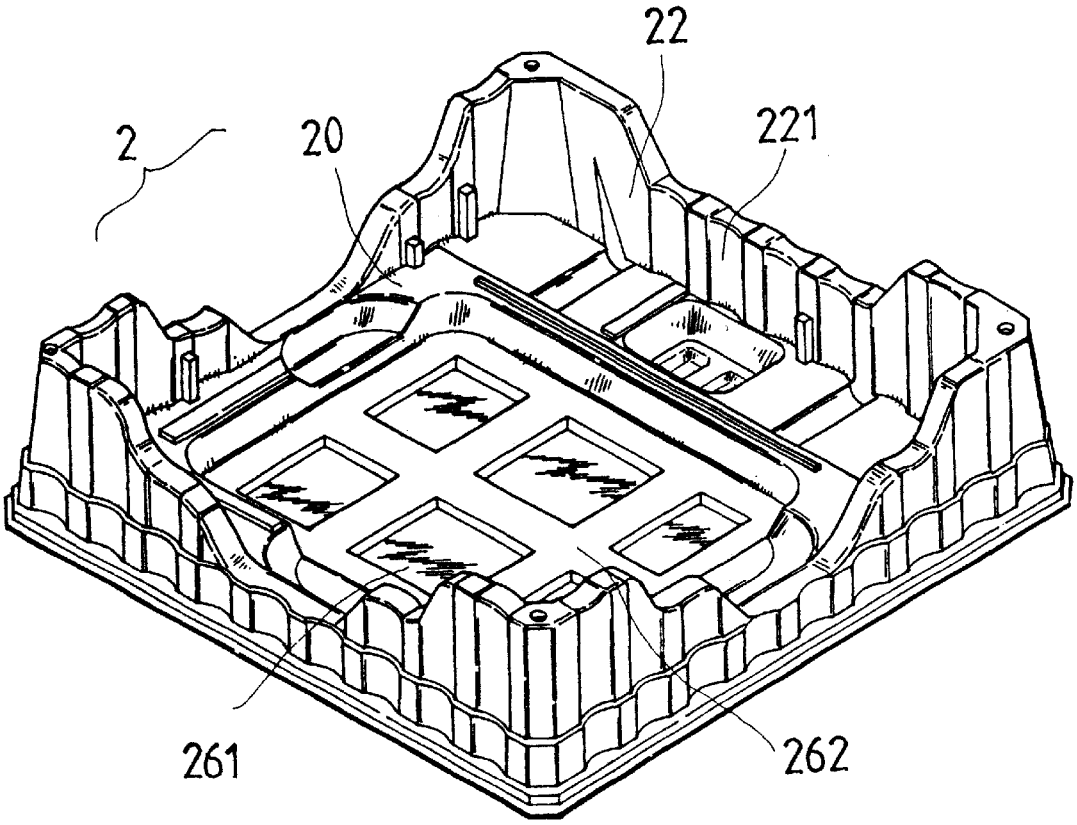
FIG. 26 is a perspective view of reinforcing projecting-up members in a lower packed case of the present invention.
Figure 29:
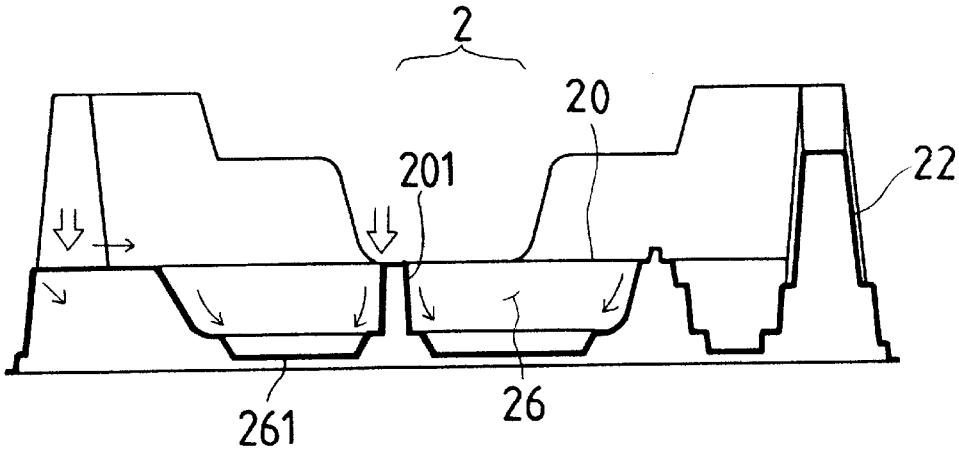
FIG. 29 is a cross-sectional view of multi-layer reinforcing projecting-up ribs in a lower package case of the present invention and showing them receiving exterior force.
Figure 28:
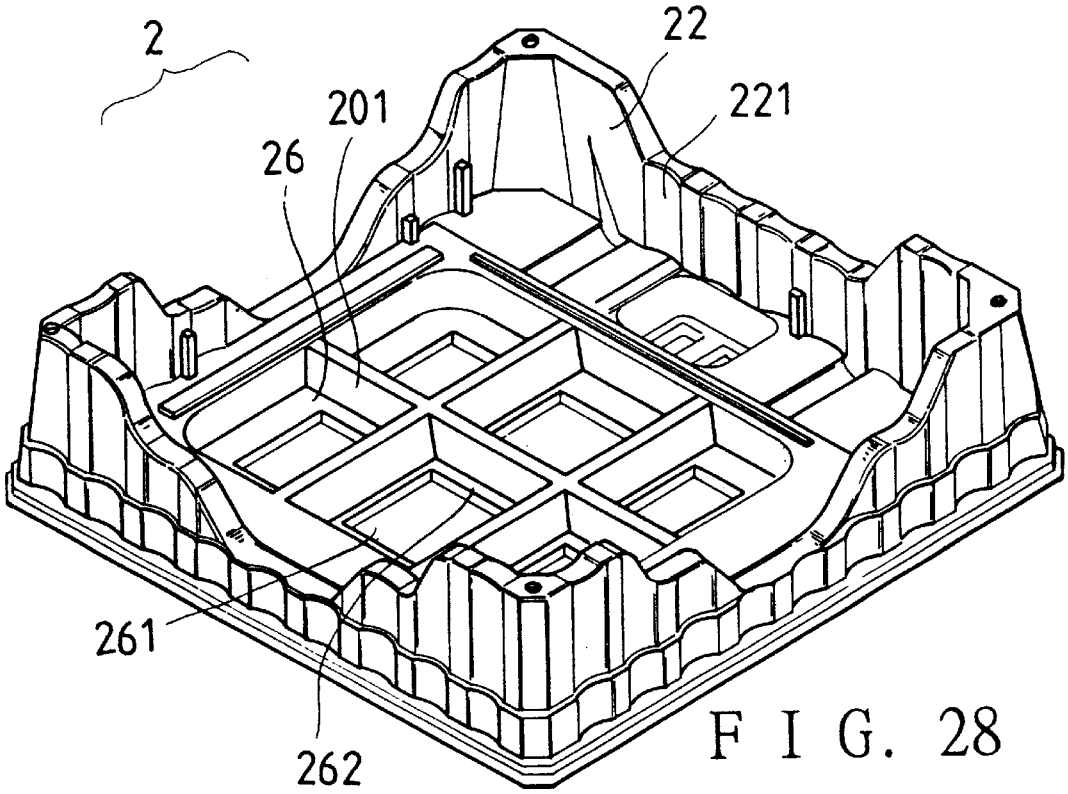
FIG. 28 is a perspective view of multi-layer reinforcing projecting-up members in a lower package case of the present invention.

Next, as shown in FIGS. 26 and 27, the lower case 2 may have reinforcing ribs 262 extending in crossing manner on the bottom wall 261 of the recess portion 26. And the recess portion 26 and each rib 262 preferably have sloping sides, as shown enlarged in FIG. 27. Besides, as shown in FIGS. 28 and 29, the height of the bottom plate 261 may be the same as that of the flat receiving surface 20, forming multi-layer walls 201 to increase shock-absorbing and buffering effect.

Figure 31:
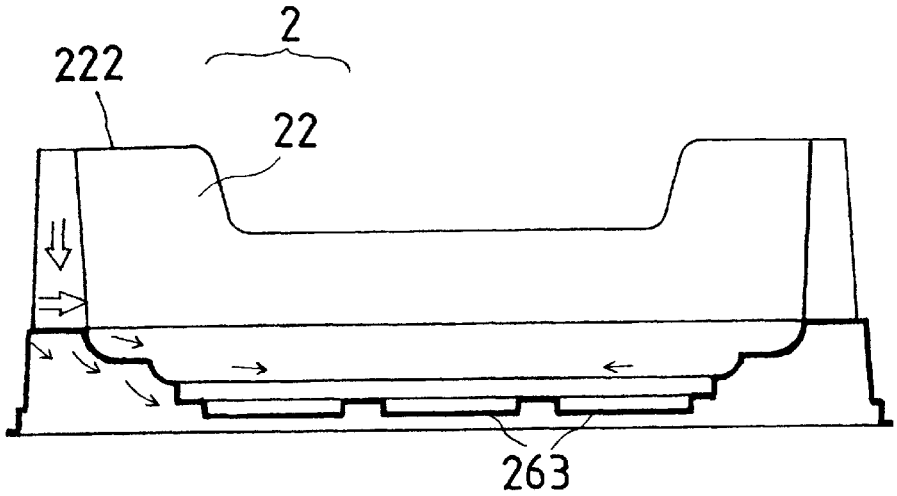
FIG. 31 is a cross-sectional view of the shallow round recesses in a lower package case of the present invention and showing them receiving exterior force.
Figure 30:
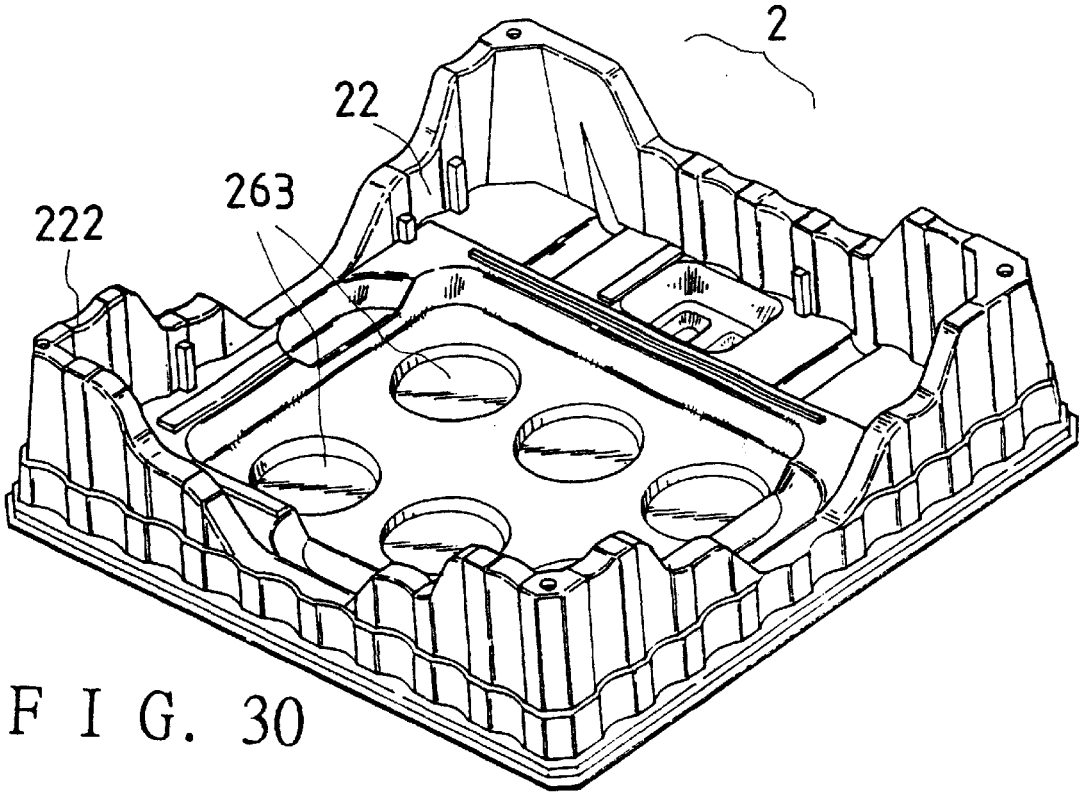
FIG. 30 is a perspective view of shallow round recesses in a lower package case of the present invention.

FIG. 30 shows plural shallow round recesses 263 may be formed on the bottom plate 261 of the recess area 26 instead of the reinforcing ribs 262, arranged in a parallel or non-parallel condition. Sides of the shallow recesses 263 and the recess area 26 preferably are sloped (forcing receiving and dispersing is shown in FIG. 31), and the four corners of the side walls 22 are formed as a little higher corner walls 222.

Figure 33:
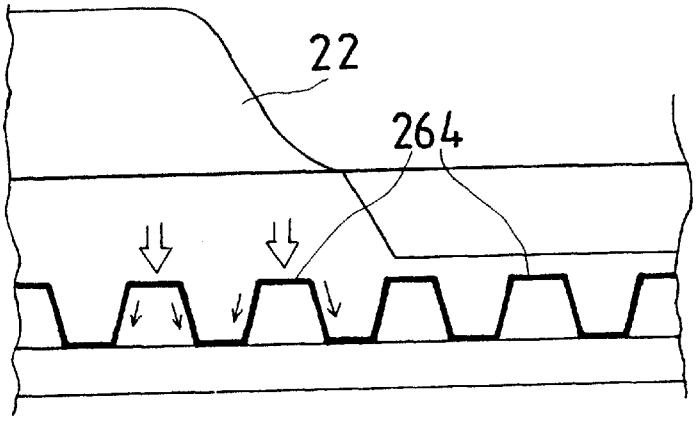
FIG. 33 is a cross-sectional view of the tabs on the bottom of a lower package case of the present invention.
Figure 32:
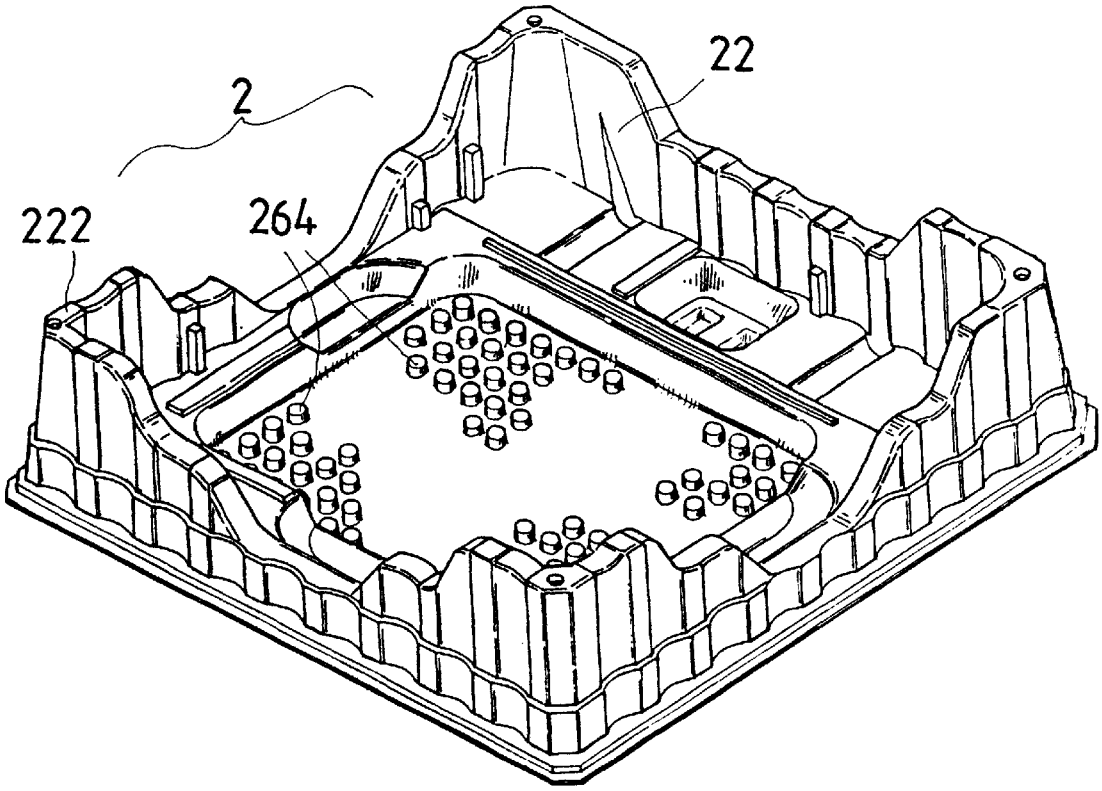
FIG. 32 is a perspective view of many tabs formed on a bottom of a lower package case of the present invention.
Figure 35:
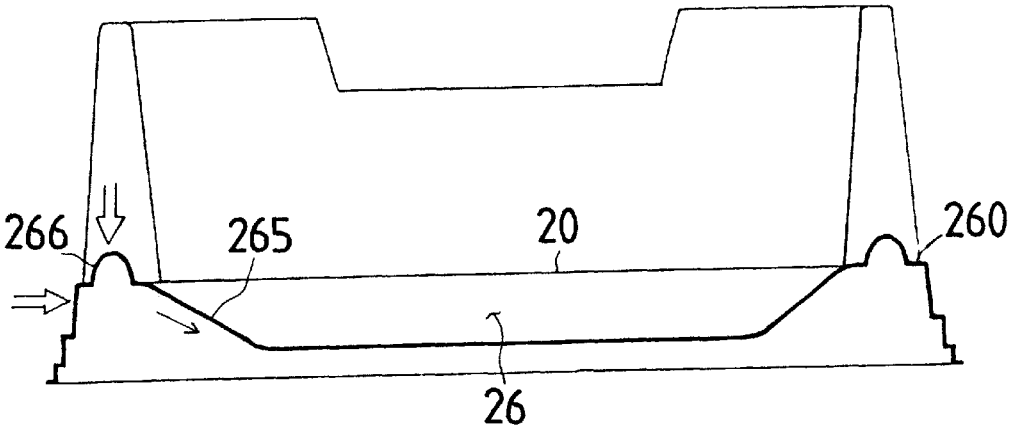
FIG. 35 is a cross-sectional view of the large slopes in the side walls of a lower package case of the present invention and showing them receiving exterior force.
Figure 34:
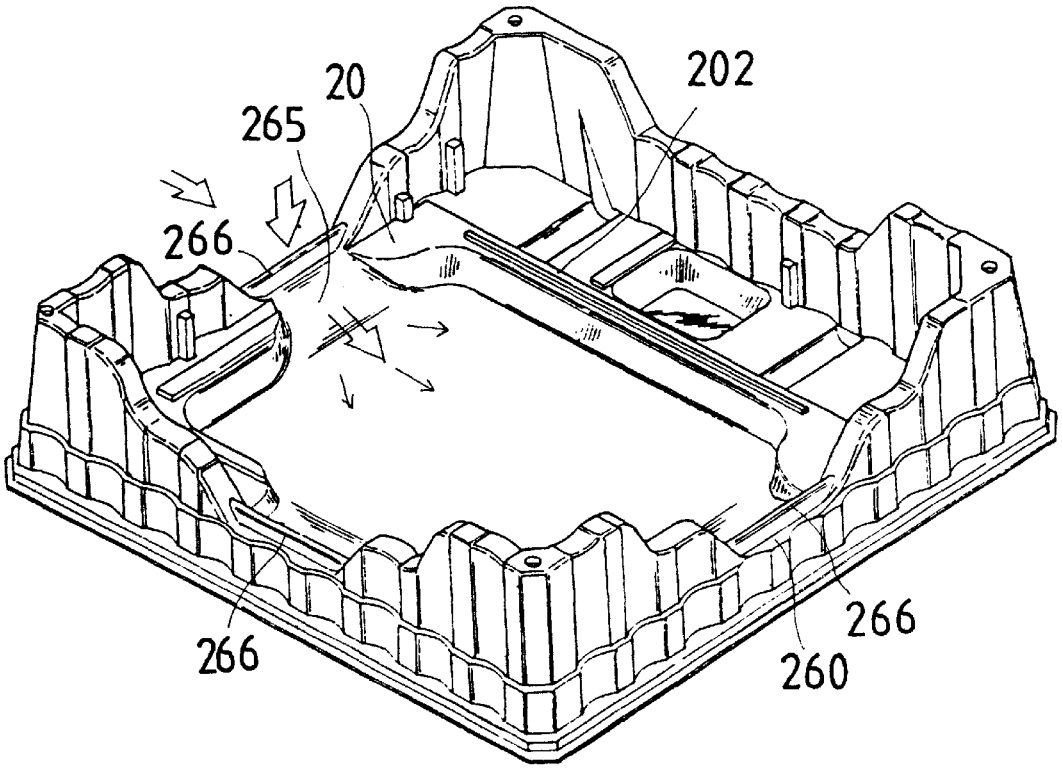
FIG. 34 is a perspective view of large slopes formed in a meddle section of the side walls of a lower package case of the present invention.
Figure 36:
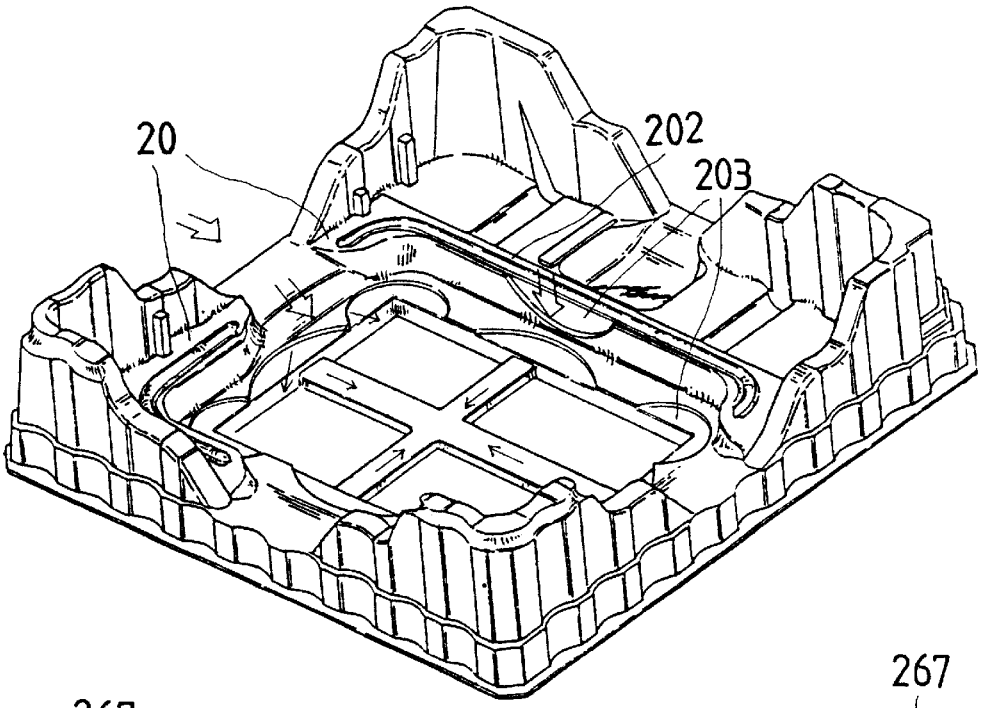
FIG. 36 is a perspective view of flat receiving surfaces with curved recesses in a lower package case of the present invention.

FIGS. 32, 33 show that the lower case 2 may have the bottom wall 261 provided with many tabs 264 for absorbing vertical vibration, and the recess portion 26 may have a comparatively large sloped surface 265 at four sides, with lateral ribs 266 added on the surfaces 265 to form a strong construction with the side walls 22. The large sloped surfaces 265 have a recessed flat surface 260 flush with the flat receiving surface 20 to absorb horizontal shock or a little lower than the flat receiving surface 20 to let shock force avoid the packed product and to let the bottom absorb it. FIG. 36 shows side walls 202 of the flat receiving surface 20 may have plural curved recesses 203 to increase vertical receiving force of the flat receiving surface 20. (Force receiving and dispersing is shown in FIGS. 34 and 35)

Figure 39:
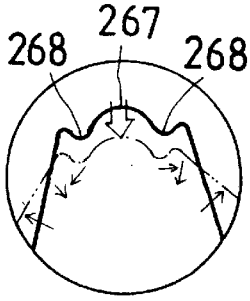
FIG. 39 is a magnified view of the convex projection of each flat receiving surface of the present invention.
Figure 38:
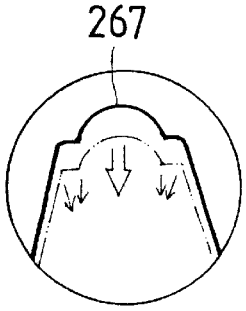
FIG. 38 is a magnified view of the convex projection of each flat receiving surface of the present invention.
Figure 37:
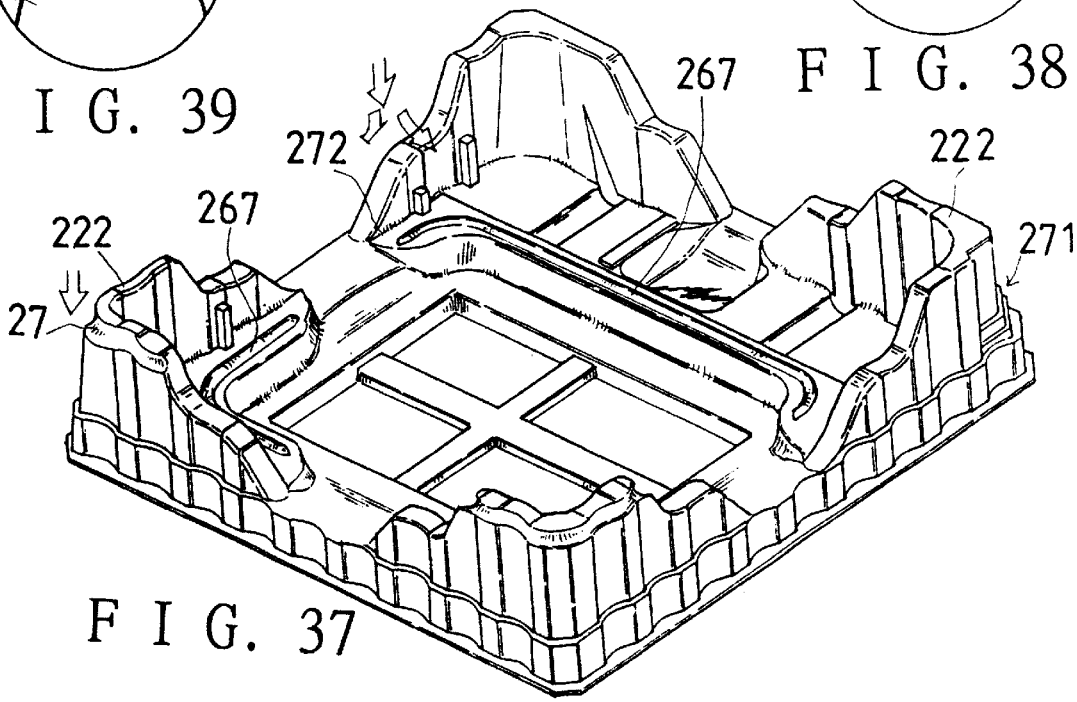
FIG. 37 is a perspective view of the flat receiving surfaces provided with convex projections in a lower package case of the present invention.

In addition, the lower case 2 may have projecting ridges 267 or other projecting means formed in outer sides of the recess portion 26 to contact directly a product, as shown in FIGS. 37 and 38. Additionally, as shown in FIG. 39, small grooves 268 may be added at two sides of the projecting ridges 267, giving buffer and shock-absorbing effect and thus lessen damage to a product laid flat on the bottom wall.

Further, a groove 27 or an angled vertical surface 271 may be provided at every corner wall 222, or an elongate semi-curved groove 272 may be formed along a side of the recess portion 26, for increasing enduring function of shocks.

In addition, the surface of the side wall 22 and the concave and convex surface 221 may be added with rough patterns to increase strength. Further, projecting ridges 267 can be recessed grooves and the small grooves 268 can be small projecting ridges.

Figure 40:
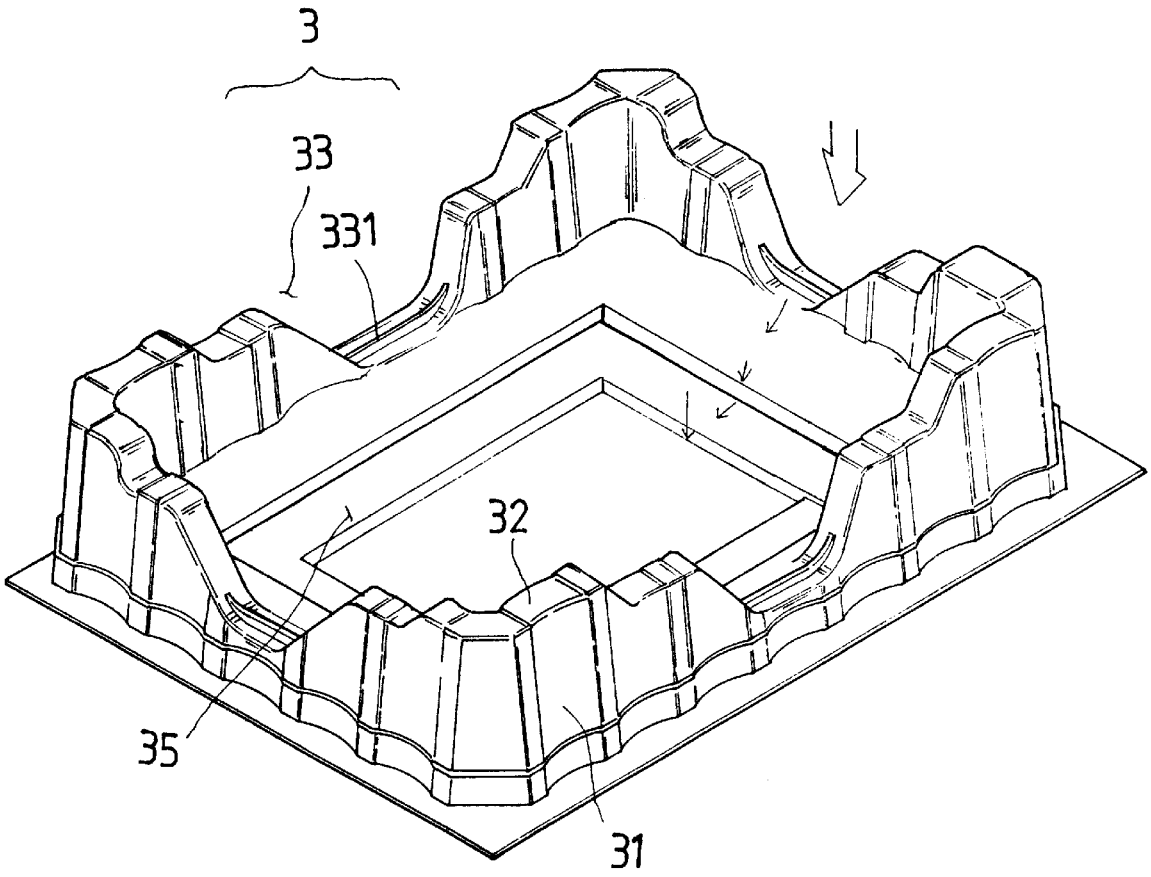
FIG. 40 is a perspective view of a first embodiment of a medium lower package case of the present invention.
Figure 41:
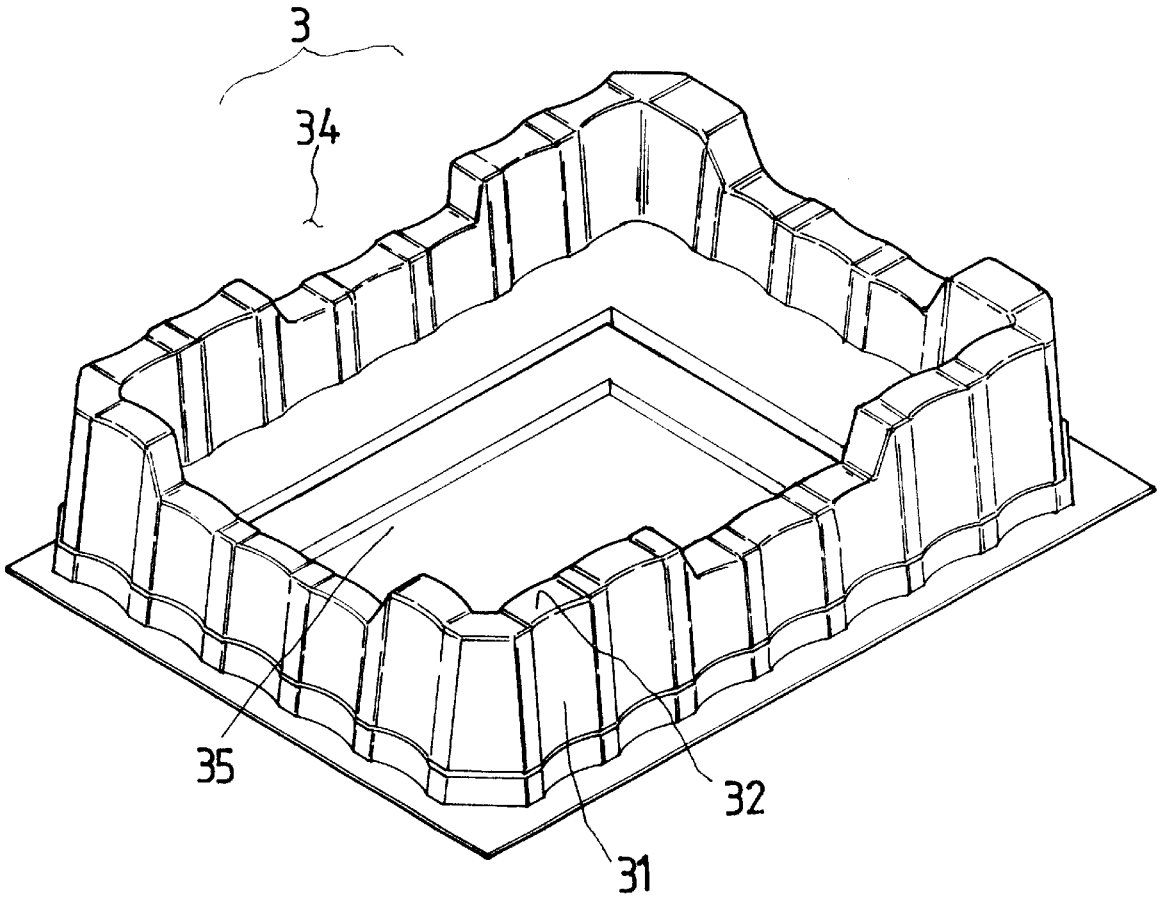
FIG. 41 is a perspective view of a second embodiment of a medium lower package case of the present invention.
Figure 42:
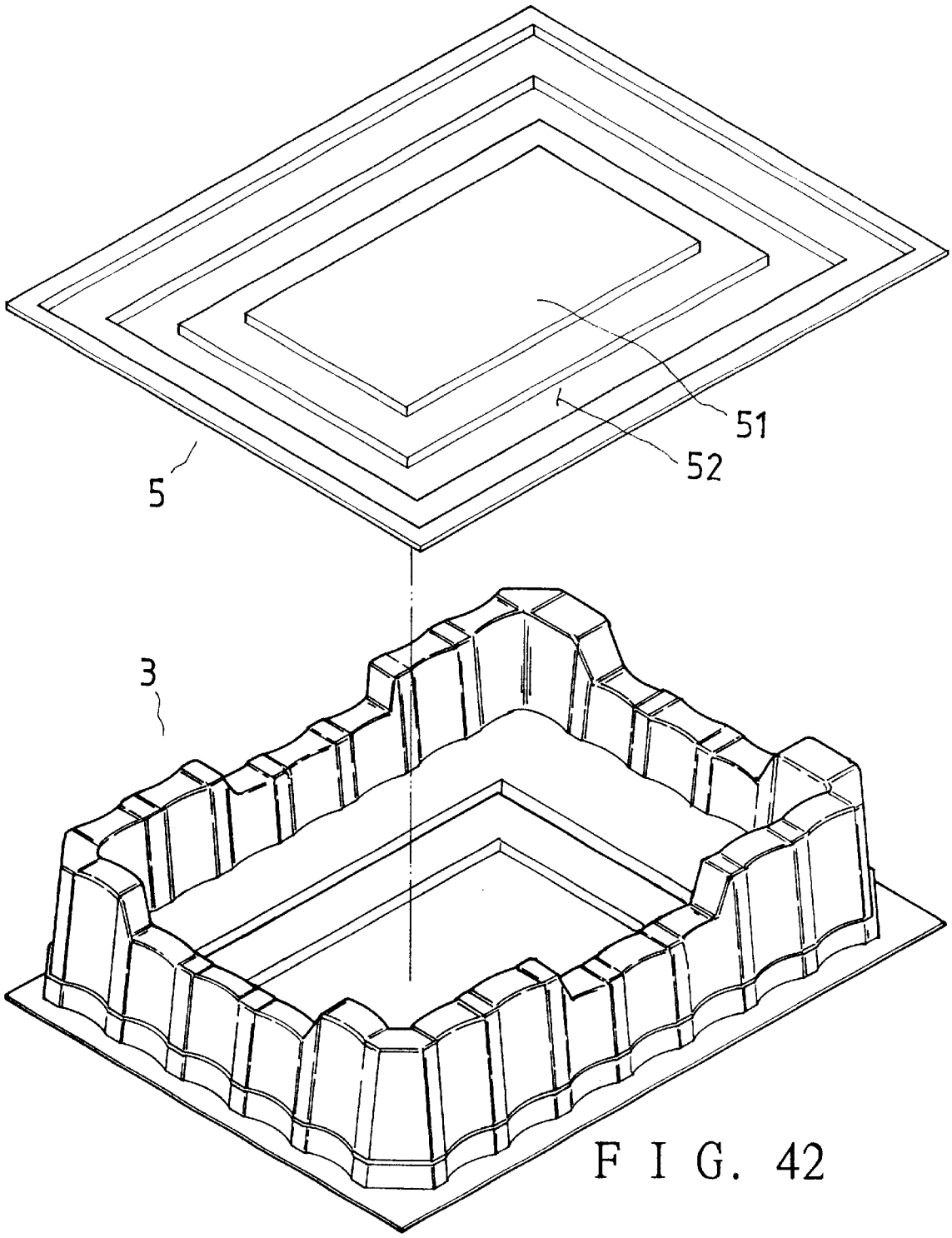
FIG. 42 is a perspective view of a third embodiment of a medium lower package case of the present invention.
Figure 43:
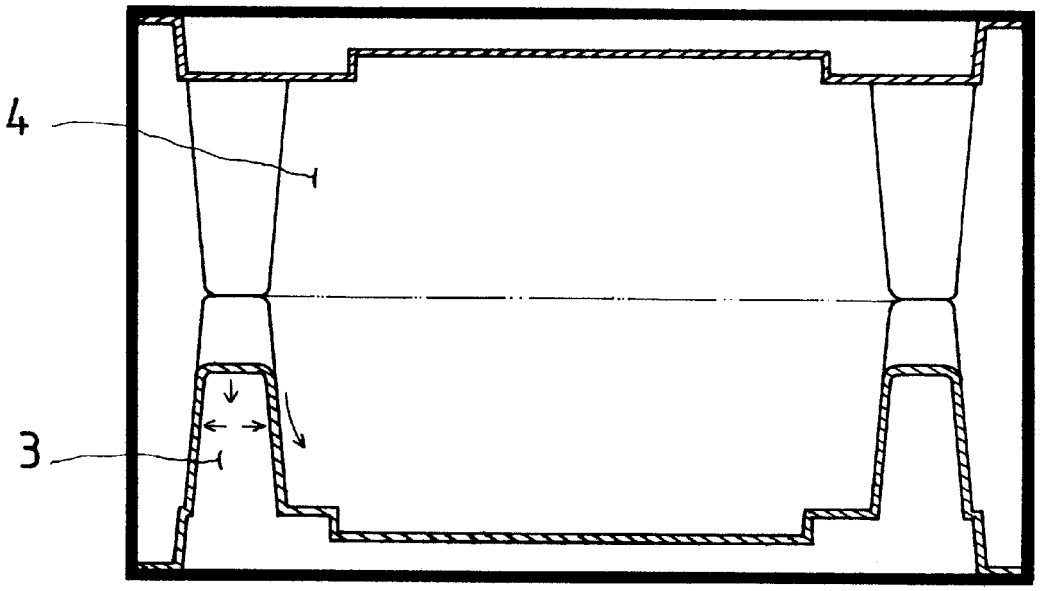
FIG. 43 is a cross-sectional view of the medium lower package case packed with an upper package case placed in a carton of the present invention.
Figure 44:
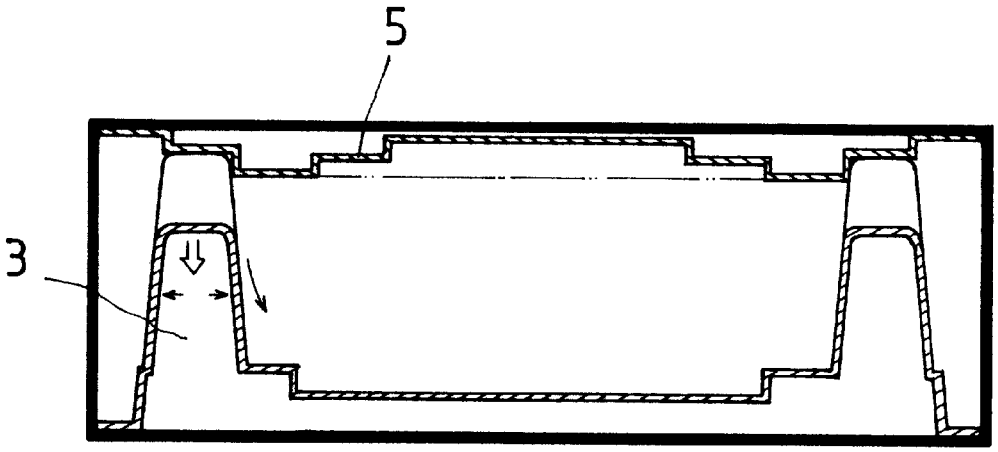
FIG. 44 is a cross-sectional view of the third embodiment of a lower package case packed with a lower package case placed in a carton of the present invention.

Further, as shown in FIG. 40, a medium lower package case 3 is formed to have concave surfaces 31 continuously on outer surfaces of the side walls 32 to reinforce them, and a deep curved opening 33 or a shallow recess 34 (shown in FIG. 41) is formed in an intermediate portion of each side wall 32, and lateral ribs 331 may be added on the deep curved opening 33. Then the deep curved openings 33 or the shallow recesses 34 may disfigure and absorb a part of shock pr force, and a step recessed bottom portion 35 may absorb the rest shock or force. The medium lower package case can be combined with an upper package case 4 shown in FIG. 43 or with a thin shallow upper package case 5 shown in FIGS. 42 and 44. The thin shallow upper package case 5 has multi-layers of step flat surfaces 51 of different dimensions and plural grooves 52 formed in the surfaces 51 so to protect a product with good effect.

Figure 46:
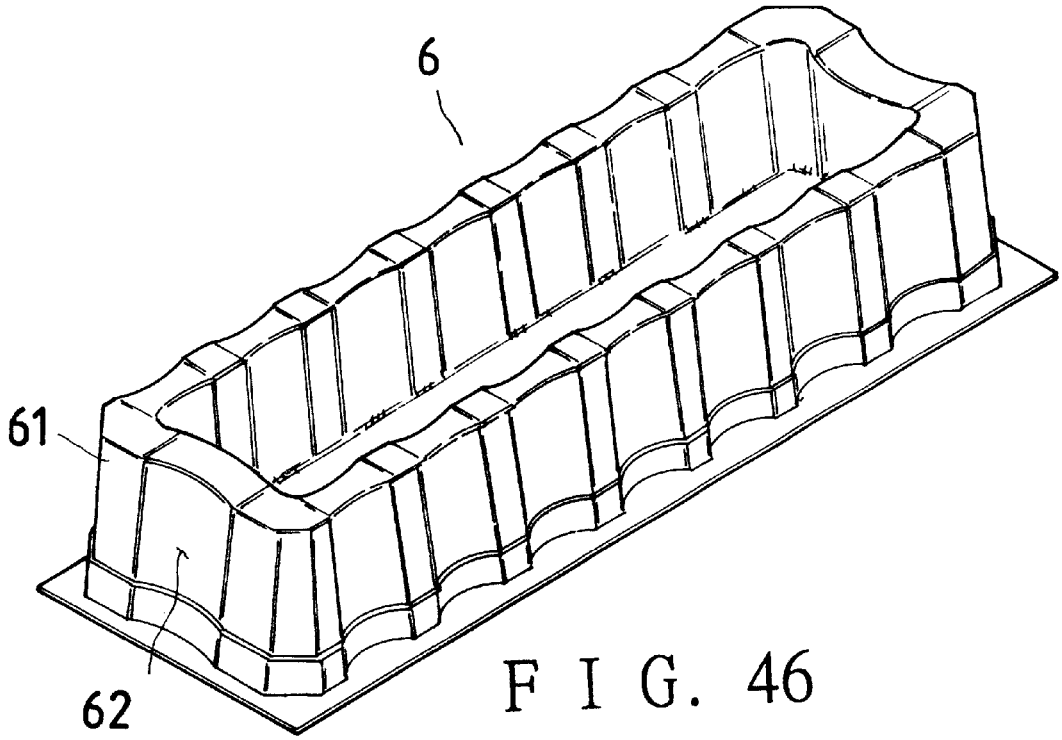
FIG. 46 is a perspective view of a second embodiment of a small lower package case of the present invention.
Figure 45:
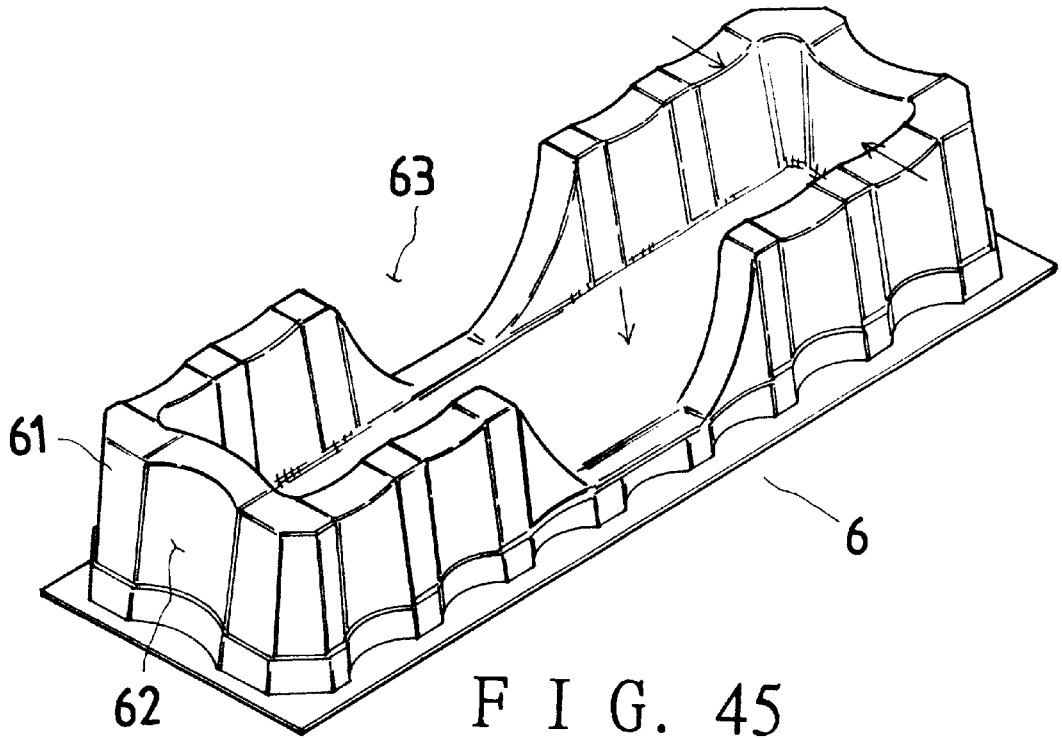
FIG. 45 is a perspective view of a first embodiment of a small lower package case of the present invention.
Figure 47:
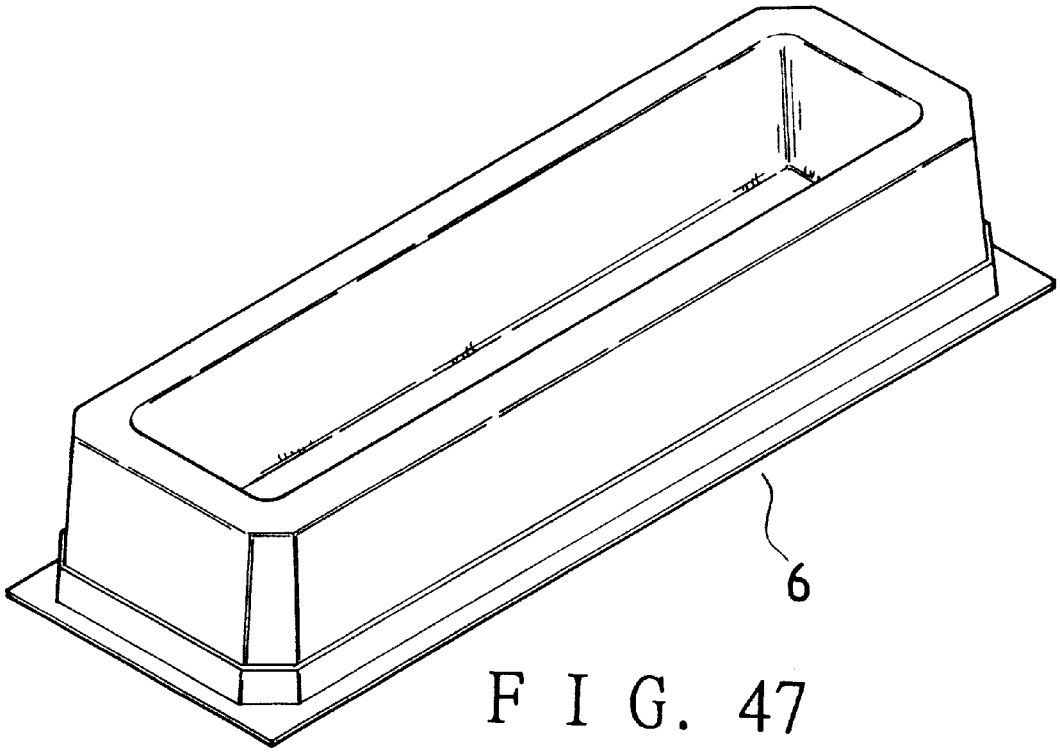
FIG. 47 is a perspective view of a third embodiment of a small lower package case of the present invention.
Figure 48:
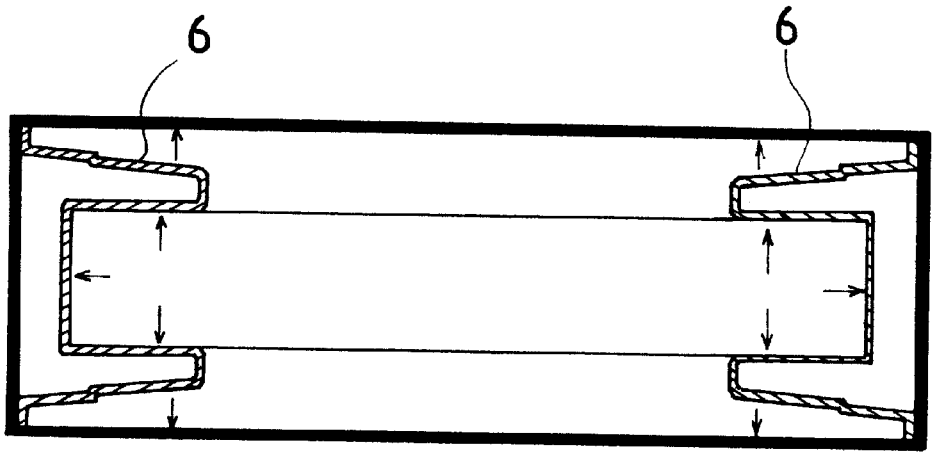
FIG. 48 is a cross-sectional view of a small lower package case packed in a carton of the present invention.

Further, as shown in FIG. 45, a small lower package case 6 has plural concave surfaces 62 on outer surfaces of the four side walls 61 to reinforce the concave surfaces 62. A deep opening 63 may be formed in an intermediate portion of two lengthwise side walls 61, as shown in FIG. 46. Moreover, the small lower package case 6 may have four sloped side walls as shown in FIG. 47. When a product is packed therein, the small case 6 can absorb and disperse shock and force effectively, as shown in FIG. 48, to protect the product from moving.

Figure 49:
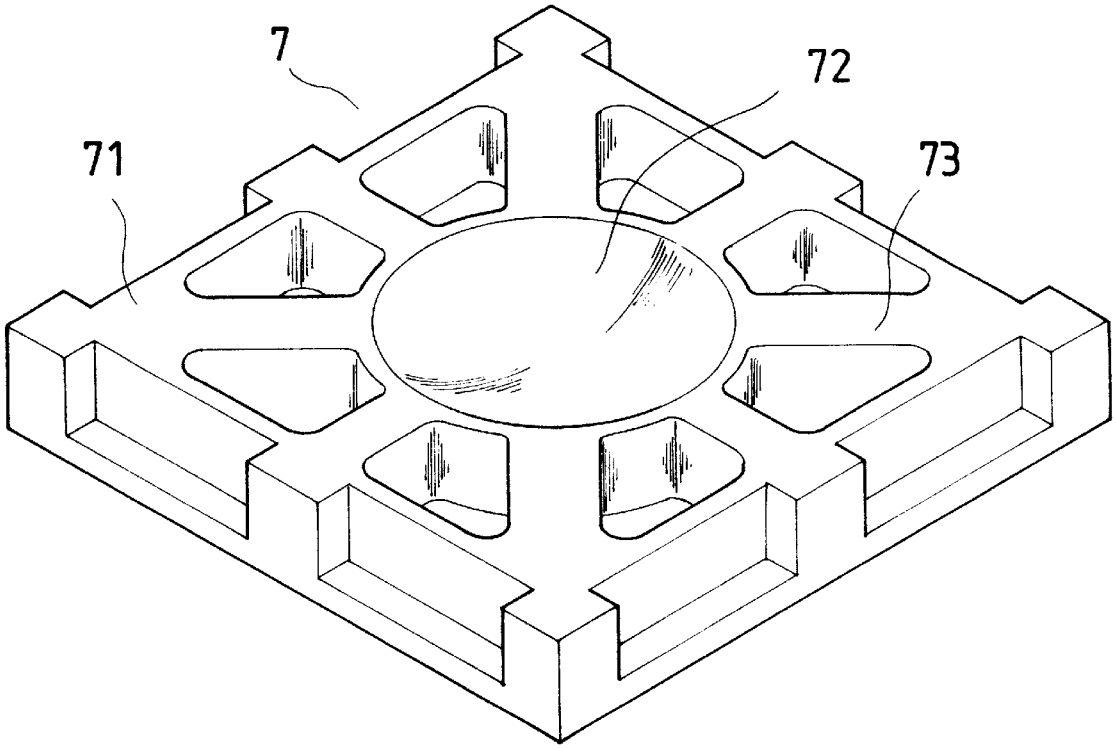
FIG. 49 is a perspective view of another embodiment of a lower package case of the present invention.
Figure 50:
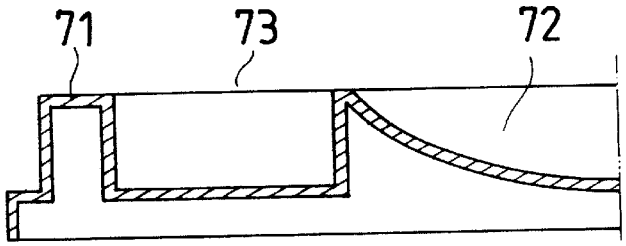
FIG. 50 is a partial cross-sectional view of the other embodiment of a lower package case of the present invention.

Referring to FIGS. 49 and 50, they provide a lower package case 7 without high side walls. The lower package case 7 provides shallow side walls 71, and ribs 73 are radially provided around a central hollow recess 72 for being a configuration absorbing any force from all directions.

Figure 51:
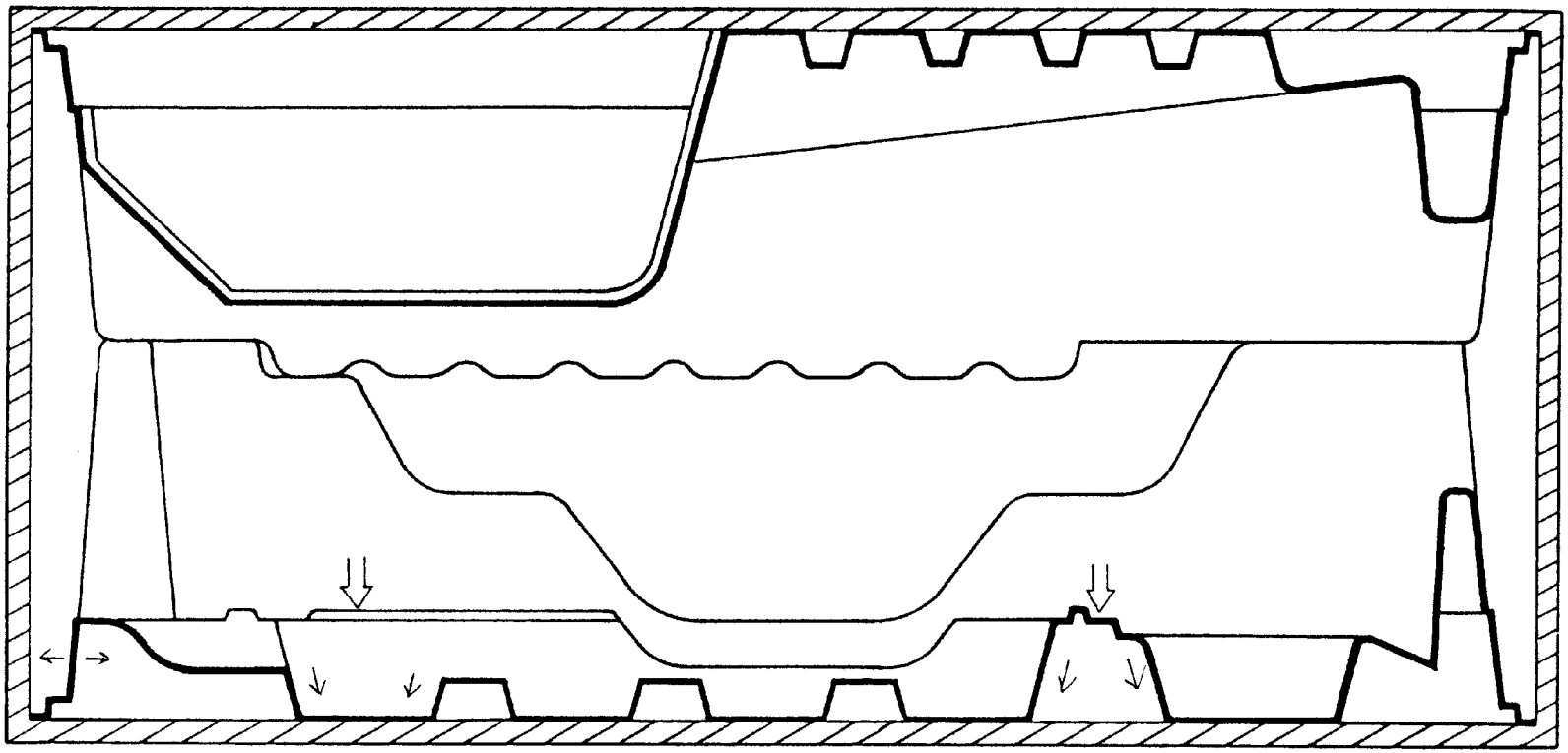
FIG. 51 is a cross-sectional view of a first example of the package case packed in a carton of the present invention.
Figure 52:
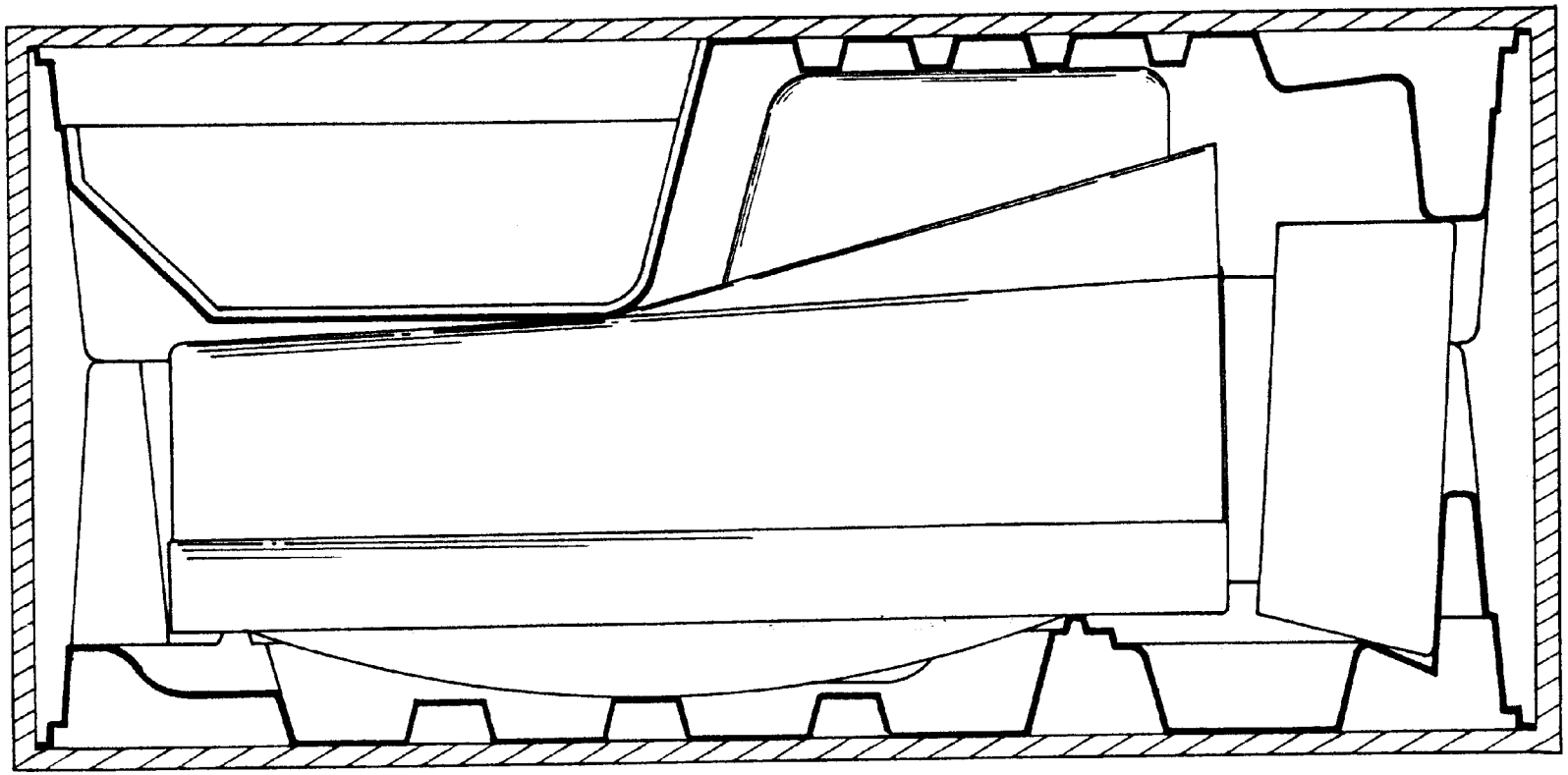
FIG. 52 is a cross-sectional view of a second example of the package case packed in a carton of the present invention.
Figure 53:
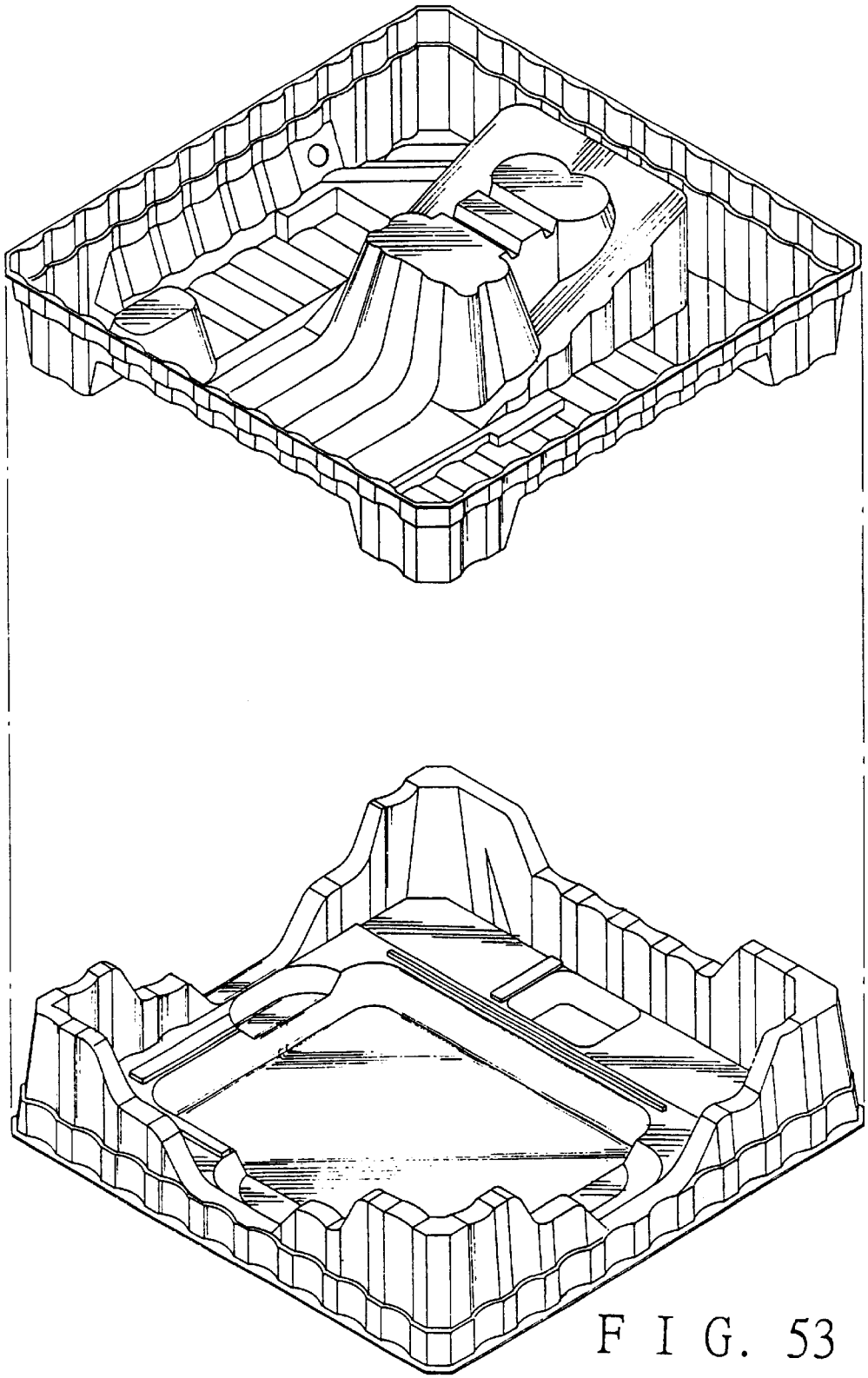
FIG. 53 is an exploded perspective view of a package case of the present invention.

The package case in the invention has the following advantages, as can be understood from the aforesaid description, and referring to FIGS. 51 and 52.

1. In order to attain or increase effect produced by air cushion of the present invention, the backs or the bottom a package case are sealed or half sealed with various kinds of plates. Moreover, the package case itself directly and tightly contact the inside surface of a carton, or air cushion is made by directly blowing in air.

2. The whole package case can have its wall made thicker or be provided with holes in order to ensure the invention sealed or half sealed not to explore or vibrate strongly by sudden shock, and formed with projections, recesses of various kinds to have enough hollow space for receiving shock and for air to circulate.

3. Its bottom is provided with various structures for a product to contact or suspend, ribs are made at places to contact to reinforce shock-absorbing, in addition to many folding recesses, enabling the package case of the invention strengthened in the whole structure to keep a product packed therein safe.

4. The recess folding extending across the large sloped surface of the upper case provides strengthening structure in other directions, staving off exterior force against the package case to reach a product packed therein, capable to disperse external force to protect the product.

5. The projecting base on the interior of the upper case is provided with a shallow recess so that the upper end of the projecting base have not only an original enduring force, but increases vertical shock enduring force, resulting in multi-layer buffers effect.

6. The projection edges of the four circumferential walls of the lower case keeps the lower case configuration and size stable, increasing suffering force against shocks.

13. The ribs crisscrossing on the bottom wall or the shallow recesses of the recess portion of the lower case may strengthen absorbing and dispersing of shocks received, hampering shocks from directly reach a product therein.

25. With the configuration of the sloped surfaces of the cartons piled with opposite sloped surfaces are able to reduce the dimensions of container when the goods are transported by container ship so as to decrease the costs of the transportation.

26. Except the side walls with concave and convex surface of the upper and lower package cases, they also can be formed in smooth and straight so as to decrease the costs of molds.

27. Except the upper package cases with sloped surfaces, a left and a right package cases or a front and a rear package cases with sloped surfaces also can be formed to hold the goods and achieve the effect as above descriptions.

What is claimed is:

1. A package case comprising:

a lower case integrally formed of a molded material, said lower case including four peripheral side walls and a bottom, said lower case having an interior space defined by said four peripheral side walls and said bottom for receiving a lower portion of a product therein; and, an upper case integrally formed of a molded material overlaying said lower case, said upper case including four peripheral side walls and a bottom, said upper case having an interior space defined by said four peripheral side walls and said bottom, said bottom of said upper case having a shaped projection for receiving an upper portion of the product therein, said projection having an end wall with shallow recesses formed therein to provide a vertical buffer, at least two of said peripheral side walls of said upper case being reinforced by a horizontal folding recess formed therein, said four peripheral side walls of both said upper and lower cases each respectively having (a) a plurality of longitudinally spaced alternating concave and convex surfaces formed therein to provide reinforcement thereof, (b) a step-shaped contour intermediate upper and lower edges thereof for further reinforcement thereof, and (c) a protruding circumferential edge, said package case thus having enough strength and buffer elasticity for wrapping the product within a carton and enduring shocks coming from any direction to protect the product wrapped therein from damage.

2. A package case comprising:

a lower case integrally formed of a molded material, said lower case including four upwardly projecting corner walls respectively disposed at four comers of said lower case, four peripheral side walls respectively extending between adjacent pairs of said corner walls, and a bottom, said lower case having an interior space defined by said four corner walls, said four peripheral side walls and said bottom for receiving a lower portion of a product therein, an upper case integrally formed of a molded material overlaying said lower case, said upper case including four downwardly projecting corner walls respectively disposed at four corners of said upper case, four peripheral side walls respectively extending between adjacent pairs of said corner walls of said upper case, and a bottom, said upper case having an interior space defined by said four corner walls, said four peripheral side walls and said bottom of said upper case for receiving an upper portion of the product therein, at least two of said peripheral side walls being reinforced by a horizontal folding recess formed therein, said four peripheral side walls of both said upper and lower cases each respectively having (a) a plurality of longitudinally spaced alternating concave and convex surfaces formed therein to provide reinforcement thereof, (b) a step-shaped contour intermediate upper and lower edges thereof for further reinforcement thereof, and (c) a protruding circumferential edge, said package case thus having enough strength and buffer elasticity for wrapping the product within a carton and enduring shocks coming from any direction to protect the product wrapped therein from damage.

3. A package case comprising:

a lower case integrally formed of a molded material, said lower case including four upwardly projecting corner walls respectively disposed at four corners of said lower case, four peripheral side walls respectively extending between adjacent pairs of said corner walls of said lower case, and a bottom, said lower case having an interior space defined by said four corner walls, said four peripheral side walls and said bottom of said lower case for receiving a lower portion of a product therein;

an upper case integrally formed of a molded material overlaying said lower case, said upper case including four downwardly projecting corner walls respectively disposed at four corners of said upper case, four peripheral side walls respectively extending between adjacent pairs of said corner walls of said upper case, and a bottom of said upper case, said upper case having an interior space defined by said four corner walls, said four peripheral side walls and said bottom of said upper case for receiving an upper portion of the product therein, at least two of said peripheral side walls of said upper case being reinforced by a horizontal folding recess formed therein, said four peripheral side walls of both said upper and lower cases respectively having (a) a plurality of longitudinally spaced alternating concave and convex surfaces formed therein to provide reinforcement thereof, (b) a stepshaped contour intermediate upper and lower edges thereof for further reinforcement thereof, and (c) a protruding circumferential edge, said package case thus having enough strength and buffer elasticity for wrapping the product within a carton and enduring shocks coming from any direction to protect the product wrapped therein from damage; and, four hook and loop fastener pairs, a first member of each of said hook and loop fastener pairs being disposed on an end portion of a respective one of said four corner walls of said upper case and a second member of each of said hook and loop fastener pairs being disposed on an end portion of a respective one of said four corner walls of said lower case in aligned relationship with a corresponding first member to releaseably couple said upper case to said lower case.

4. A package case comprising:

a lower case integrally formed of a molded material, said lower case including four upwardly projecting corner walls respectively disposed at four corners of said lower case, four peripheral side walls respectively extending between adjacent pairs of said corner walls, and a bottom, said bottom having a plurality of intersecting ribs formed therein for increasing structural strength thereof, said lower case having an interior space defined by said four corner walls, said four peripheral side walls and said bottom for receiving a lower portion of a product therein, an upper case integrally formed of a molded material overlaying said lower case, said upper case including four downwardly projecting corner walls respectively disposed at four corners of said upper case, four peripheral side walls respectively extending between adjacent pairs of said corner walls of said upper case, and a bottom, said upper case having an interior space defined by said four corner walls, said four peripheral side walls and said bottom of said upper case for receiving an upper portion of the product therein, at least two of said peripheral side walls being reinforced by a horizontal folding recess formed therein, said four peripheral side walls of both said upper and lower cases each respectively having (a) a plurality of longitudinally spaced alternating concave and convex surfaces formed therein to provide reinforcement thereof, (b) a step-shaped contour intermediate upper and lower edges thereof for further reinforcement thereof, and (c) a protruding circumferential edge, said package case thus having enough strength and buffer elasticity for wrapping the product within a carton and enduring shocks coming from any direction to protect the product wrapped therein from damage.

* * * * *